US008263298B1

(12) United States Patent
Yu et al.

(10) Patent No.: US 8,263,298 B1
(45) **Date of Patent: *Sep. 11, 2012**

(54) ELECTRICALLY TUNABLE AND STABLE IMAGING MEMBERS

(75) Inventors: Robert C. U. Yu, Webster, NY (US); Stephen T. Avery, Rochester, NY (US); Jimmy E. Kelly, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/034,654

(22) Filed: Feb. 24, 2011

(51) Int. Cl.
*G03G 5/00* (2006.01)

(52) U.S. Cl. ..... 430/59.6

(58) Field of Classification Search ..... 430/59.6
See application file for complete search history.

(56) References Cited

U.S. PATENT DOCUMENTS

| | | | |
|---|---|---|---|
| 3,121,006 | A | 2/1964 | Middleton et al. |
| 3,820,989 | A | 6/1974 | Rule et al. |
| 3,837,851 | A | 9/1974 | Shattuck et al. |
| 3,895,944 | A | 7/1975 | Wiedemann et al. |
| 4,150,987 | A | 4/1979 | Anderson et al. |
| 4,245,021 | A | 1/1981 | Kazami et al. |
| 4,256,821 | A | 3/1981 | Enomoto et al. |
| 4,278,746 | A | 7/1981 | Goto et al. |
| 4,286,033 | A | 8/1981 | Neyhart et al. |
| 4,291,110 | A | 9/1981 | Lee |
| 4,297,426 | A | 10/1981 | Sakai et al. |
| 4,315,982 | A | 2/1982 | Ishikawa et al. |
| 4,338,387 | A | 7/1982 | Hewitt |
| 4,338,388 | A | 7/1982 | Sakai et al. |
| 4,385,106 | A | 5/1983 | Sakai |
| 4,387,147 | A | 6/1983 | Sakai |
| 4,399,207 | A | 8/1983 | Sakai et al. |
| 4,399,208 | A | 8/1983 | Takasu et al. |
| 4,587,189 | A | 5/1986 | Hor et al. |
| 4,664,995 | A | 5/1987 | Horgan et al. |
| 4,988,597 | A | 1/1991 | Spiewak et al. |
| 5,215,839 | A | 6/1993 | Yu |
| 5,244,762 | A | 9/1993 | Spiewak et al. |
| 5,660,961 | A | 8/1997 | Yu |
| 5,697,024 | A | 12/1997 | Mishra |
| 5,703,487 | A | 12/1997 | Mishra |
| 5,756,245 | A | 5/1998 | Esteghamatian et al. |
| 5,958,638 | A | 9/1999 | Katayama et al. |
| 6,008,653 | A | 12/1999 | Popovic et al. |
| 6,119,536 | A | 9/2000 | Popovic et al. |
| 6,124,514 | A | 9/2000 | Emmrich et al. |
| 6,150,824 | A | 11/2000 | Mishra et al. |

(Continued)

OTHER PUBLICATIONS

U.S. Appl. No. 12/551,414, filed Aug. 31, 2009, Yu et al.

(Continued)

*Primary Examiner* — Mark A Chapman
(74) *Attorney, Agent, or Firm* — Pillsbury Winthrop Shaw Pittman LLP

(57) ABSTRACT

Embodiments provide novel imaging members used in electrostatography. More particularly, there is provided flexible electrophotographic imaging members which have improved imaging layer(s) formulated to comprise of a plasticizer in a material matrix of a solid solution comprising a charge transporting compound and a film forming polymer binder which is a novel A-B diblock copolymer or a binary polymer blend of a novel A-B diblock copolymer and a bisphenol polycarbonate. The flexible imaging members thus prepared have improved photoelectrical cyclic function stability, chemical resistive property, and are curl-free, and thus eliminate the need for an additional anticurl back coating layer.

25 Claims, 6 Drawing Sheets

U.S. PATENT DOCUMENTS

| | | | |
|---|---|---|---|
| 6,214,514 | B1 | 4/2001 | Evans et al. |
| 6,326,111 | B1 | 12/2001 | Chambers et al. |
| 6,756,169 | B2 | 6/2004 | Lin et al. |
| 6,933,089 | B2 | 8/2005 | Horgan et al. |
| 7,008,741 | B2 | 3/2006 | Yu et al. |
| 7,018,756 | B2 | 3/2006 | Pai et al. |
| 7,033,714 | B2 | 4/2006 | Horgan et al. |
| 2010/0168062 | A1 | 7/2010 | Gerspacher |
| 2011/0305981 | A1* | 12/2011 | Yu et al. ..... 430/56 |

OTHER PUBLICATIONS

U.S. Appl. No. 12/551,440, filed Aug. 3, 2009, Yu et al.
U.S. Appl. No. 12/782,671, filed May 18, 2010, Yu et al.

* cited by examiner

ELECTRICALLY TUNABLE AND STABLE IMAGING MEMBERS

BACKGROUND

The presently disclosed embodiments are directed to imaging members used in electrostatography. More particularly, the embodiments pertain to the preparation of flexible electrophotographic imaging members which have improved imaging layer(s) formulated to comprise of a plasticizer in a material matrix of a solid solution comprising a charge transporting compound and a film forming polymer binder which is a novel A-B diblock copolymer or a binary polymer blend of a novel A-B diblock copolymer and a bisphenol polycarbonate. The flexible imaging members thus prepared have improved photoelectrical cyclic function stability, chemical resistive property, and are curl-free, and thus eliminate the need for an additional anticurl back coating layer. The present disclosure relates to all types of flexible electrostatographic imaging members used in electrostatography.

In electrostatographic reproducing apparatuses, including digital, image on image, and contact electrostatic printing apparatuses, a light image of an original to be copied is typically recorded in the form of an electrostatic latent image upon a photosensitive member and the latent image is subsequently rendered visible by the application of electroscopic thermoplastic resin particles and pigment particles, or toner. Flexible electrostatographic imaging members are well known in the art. Typical electrostatographic imaging members include, for example: (1) electrophotographic imaging members (photoreceptors) commonly utilized in electrophotographic (xerographic) processing systems; (2) electroreceptors such as ionographic imaging members for electrographic imaging systems; and (3) intermediate toner image transfer members such as an intermediate toner image transferring belt which is used to remove the toner images from a photoreceptor surface and then transfer the very images onto a receiving paper. All the electrostatographic imaging members are prepared in either flexible belt form or rigid drum configuration and could either be a negatively charged or positively charged design.

For a typical flexible electrophotographic imaging member belt used in a negatively charged imaging system, the imaging member belt comprises a charge transport layer, a charge generating layer, and optional layers on one side of a supporting substrate layer and does also include an anticurl back coating on the opposite side of the substrate to imaging member flatness. In this flexible electrophotographic imaging member, where the charge generating layer is sandwiched between the top outermost exposed charge transport layer and the electrically conducting layer, the outer surface of the charge transport layer is charged negatively and the conductive layer is charged positively. The charge generating layer should be capable of generating electron hole pair when exposed imagewise and inject only the holes through the charge transport layer. In the alternate case where the charge transport layer is sandwiched between the charge generating layer and the conductive layer, the outer surface of the charge generating layer is charged positively while conductive layer is charged negatively and the holes are injected through from the charge generating layer to the charge transport layer. The charge transport layer should be able to transport the holes with as little trapping of charge as possible. In a typical flexible imaging member belt such as photoreceptor, the charge conductive layer may be a thin coating of metal on a flexible substrate support layer which also provided with an anticurl back coating to render imaging member flatness.

A typical flexible electrographic imaging member belt may, however, have a more simple material structure and include a dielectric imaging layer on one side of a supporting substrate and an anti-curl back coating on the opposite side of the substrate to render flatness. Alternatively, the electrostatographic imaging members can also be a rigid member, such as those utilizing a rigid substrate support drum. For these drum imaging members, having a thick and rigid cylindrical supporting substrate bearing the imaging layer(s), no application of an anticurl back coating layer is needed.

All the flexible electrostatographic imaging members may be seamless or seamed belts. Seamed belts are usually formed by cutting a rectangular sheet from a web, overlapping opposite ends, and welding the overlapped ends together to form a welded seam.

Although the scope of the present embodiments covers the preparation of all types of electrostatographic imaging members in flexible belt design or rigid drum configuration, for reasons of simplicity, the discussion hereinafter will focus and be represented only by flexible electrophotographic imaging member belts of negatively charged design.

Typical and conventional negatively-charged electrophotographic imaging member belts, such as photoreceptor in conventional flexible belt designs, are made of multiple layers comprising a flexible supporting substrate, a conductive ground plane, a charge blocking layer, an optional adhesive layer, a charge generating layer, and a typical charge transport layer of about 29 micrometers in thickness. The charge transport layer is the thickest and usually the last layer, or the exposed outermost layer, to be coated and is applied by solution coating then followed by drying the wet applied coating at elevated temperatures of about 120° C., and finally cooling it down to ambient room temperature of about 25° C. When a production web stock of several thousand feet of coated multilayered photoreceptor material is obtained after finishing solution application of the charge transport layer coating and through drying/cooling process, upward curling of the multilayered photoreceptor is observed. This upward curling is a consequence of thermal contraction mismatch between the charge transport layer and the substrate support. Since the charge transport layer in a typical electrophotographic imaging member device has a coefficient of thermal contraction approximately 3.7 times greater than that of the flexible substrate support, the charge transport layer does therefore have a larger dimensional shrinkage than that of the substrate support as the imaging member web stock cools down to ambient room temperature.

The exhibition of imaging member curling after completion of charge transport layer coating is due to the consequence of the heating/cooling processing step, according to the mechanism: (1) as the web stock carrying the wet applied charge transport layer is dried at elevated temperature, dimensional contraction does occur when the wet charge transport layer coating is losing its solvent during 120° C. elevated temperature drying, but at 120° C. the charge transport layer remains as a viscous flowing liquid after losing its solvent. Since its glass transition temperature ($T_g$) is typically between 85 and 90° C. (depending on the polymer binder used), the charge transport layer after loss of the solvent will re-adjust itself, release internal stress, and maintain its dimension stability; (2) as the charge transport layer now in the viscous liquid state is cooling down further and reaching its glass transition temperature ($T_g$), the charge transport layer instantaneously solidifies and adheres to the charge generating layer because it has then transformed itself from being a viscous liquid into a solid layer at its $T_g$; and (3) eventual cooling down the solid charge transport layer of the imaging member web from its Tg down to 25° C. room ambient will then cause the charge transport layer to contract more than the substrate support since it has about 3 to 4 times greater thermal coefficient of dimensional contraction than that of the substrate support. This differential in dimensional contraction results in tension strain built-up in the charge transport layer which therefore, at this instant, pulls the imaging member upward to exhibit curling. If unrestrained at this point, the imaging member web stock (having a 29-micrometer charge transport layer and using a 3½ mil thick polyethylene terephthalate substrate) will spontaneously curl upwardly into a 1.5-inch tube. To offset the curling, an anticurl back coating is applied to the backside of the flexible substrate support, opposite to the side having the charge transport layer, and renders the imaging member web stock with desired flatness.

Electrophotographic imaging member web upward curling is undesirable because it hinders fabrication of the web into cut sheets and subsequent welding into a belt. Moreover, imaging member belt curling affects electrical charging uniformity across the belt width, under photo-electrical machine belt function condition, causing copy printout quality degradation. An anticurl back coating, having an equal counter curling effect but in the opposite direction to the applied imaging layer(s), is applied to the reverse side of substrate support of the active imaging member to balance the curl caused by the mismatch of the thermal contraction coefficient between the substrate and the charge transport layer, resulting in greater charge transport layer dimensional shrinkage than that of the substrate. Although the application of an anticurl back coating is effective to counter and remove the curl, the resulting imaging member in flat configuration creates tension and an internal built-in strain in the charge transport layer of about 0.27 percent in the layer. The magnitude of charge transport layer internal built-in strain is very undesirable, because it is additive to the induced bending strain of an imaging member belt as the belt bends and flexes over each belt support roller during dynamic fatigue belt cyclic motion under a normal machine electrophotographic imaging function condition in the field. The summation of the internal strain and the cumulative fatigue bending strain sustained in the charge transport layer has been found to exacerbate the early onset of charge transport layer fatigue/flexing induced cracking, preventing the belt to reach its targeted functional imaging life. Moreover, imaging member belt employing an anticurl backing coating has additional total belt thickness to thereby increase charge transport layer bending strain and speed up belt cycling fatigue charge transport layer cracking. The cracks formed in the charge transport layer as a result of dynamic belt fatiguing are found to manifest themselves into copy print-out defects, which thereby adversely affect the image quality on the receiving paper.

Various belt function deficiencies have also been observed in the common anticurl hack coating formulations used in a typical conventional imaging member belt, such as the anticurl back coating does not always provide satisfying dynamic imaging member belt performance result under a normal machine functioning condition. For example, exhibition of anticurl back coating wear and its propensity to cause electrostatic charging-up are the frequently seen problems to prematurely cut short the service life of a belt and requires its frequent costly replacement in the field. Anticurl back coating wear under the normal imaging member belt machine operational conditions reduces the anticurl back coating thickness, causing the loss of its ability to fully counteract the curl as reflected in exhibition of gradual imaging member belt curling up in the field. Curling is undesirable during imaging belt function because it leads to non-uniform charging. In addition, developer applicators and the like, during the electrophotographic imaging process, may all adversely affect the quality of the ultimate developed images. For example, non-uniform charging distances can manifest as variations in high background deposits during development of electrostatic latent images near the edges of paper. Since the anticurl back coating is an outermost exposed backing layer and has high surface contact friction when it slides over the machine subsystems of belt support module, such as rollers, stationary belt guiding components, and backer bars, during dynamic belt cyclic function, these mechanical sliding interactions against the belt support module components not only exacerbate anticurl back coating wear, it does also cause the relatively rapid wearing away of the anti-curl produce debris which scatters and deposits on critical machine components such as lenses, corona charging devices and the like, thereby adversely affecting machine performance. Moreover, anticurl back coating abrasion/scratch damage also produces unbalance force generation between the charge transport layer and the anticurl back coating to cause micro belt ripples formation during electrophotographic imaging processes, resulting in streak line print defects in output copies which deleteriously impact image printout quality and shorten the imaging member belt functional life.

Moreover, high contact friction of the anticurl back coating against machine subsystems is further seen to cause the development of electrostatic charge built-up problem. Static charge built-up in anticurl back coating increases belt drive torque, in some instances, has also been found to result in absolute belt stalling. In other cases, the electrostatic charge build up in the anticurl back coating during dynamic imaging member belt cyclic motion can be so high as to cause electrical sparking.

Lastly, the inclusion of an anticurl back coating as an added coating layer contributes to manufacturing cost. Moreover, application of anticurl back coating requires the imaging member web to be unwound and re-sent through the coater to add the anticurl back coating layer and increases the chances that the charge transport layer will be damaged from extra handling, thus adding to the imaging member production yield loss.

To overcome all these shortcomings, several attempts to eliminate the need for an anticurl back coating have been pursued. One of the more successful anticurl back coating-free flexible imaging members was achieved by reducing the charge transport layer internal stress/strain build-up, through incorporation of a plasticizer in the layer to minimize/eliminate the tension pulling force and effect curl suppression. For example, U.S. Pat. No. 6,183,921 discloses a crack resistant and curl-free electrophotographic imaging member in which the charge transport layer is comprised of an active charge transporting polymeric tetraaryl-substituted biphenyldiamine and a plasticizer. U.S. Pat. No. 7,008,741; discloses an imaging member having the charge transport layer and an optional overcoat formulated with the used of cross-linking a liquid carbonate. The imaging electrostatographic member obtained exhibits improved service life. U.S. patent application Ser. No. 12/551,414 to Yu et al. discloses an imaging member having a charge transport layer comprising a mix of plasticizers. U.S. patent application Ser. Nos. 12/551,440 and 12/782,671, both to Yu et al., disclose an imaging member having a charge transport layer comprising a single plasticizer or at least a single plasticizer. U.S. patent application Ser. No. 12/663,698 to Yu et al. discloses an imaging member having a charge transport layer comprising a single plasticizer. U.S. patent application Ser. No. 12/633,698 to Tong et al. discloses an imaging members comprising fluoroketone and 12/726,207 to Yu et al. discloses curl-free imaging members with slippery surface.

Although the attempts described in all the above disclosures are encouraging, the results were limited since those imaging members were unable to yield an absolute imaging member flatness due to the limitation of plasticizer that can be incorporated into the charge transport layer material matrix for effecting total internal stress/strain relief and without negatively impacting the photo-electrical performance of the prepared imaging members. Because for plasticizer loading level exceeding 9 weight percent (based on the total weight of the charge transport layer formulated to comprise a polycarbonate, diamine charge transporting compound, and di-ethyl phthalate plasticizer) in the charge transport layer of a typical imaging member, electrical $V_e$ cycle-up has been discovered to be an issue and impacts copy printout quality: the appearance of negative image ghosting defects became evident in the print copies after few thousand print volumes. Even though total elimination of the residual curling to effect reasonable imaging member flatness for the 9 weight percent loaded charge transport layer was alternatively achievable by using thicker substrate support for greater beam rigidity to resist curl, the increase in the total imaging member thickness had the undesirable consequence of increasing the imaging member belt surface bending stress/strain to exacerbate early onset of charge transport layer cracking under a normal machine belt fatigue cyclic function condition over each belt module support rollers in the field.

In addition, another print quality problem associated with the conventional negatively charged imaging member has also recently emerged in the field, which is the ghosting image copy print defect. Result of chemical analysis has determined that the root cause of xerographic image print defects lies on absorption of amine species on the surface of the imaging member since the pre-printed images are formed on these papers with the use of amine agents catalyzed ultraviolet (UV) cured ink prior to xerographic imaging formation, resulting in amine vapor impact on copy printout quality degradation. The deposition and accumulation of amine residues onto the imaging member charge transport layer surface, after repeatedly making contact with receiving papers during xerographic imaging process, is found to cause ghosting image defects print-out in the output copies. Since ghosting image defects in the output copies are unacceptable print quality failures, it requires frequent costly imaging member replacement in the field.

To overcome the limitation of anticurl back coating-free imaging member designs developed in recent years and to eliminate the pre-printed paper amine contaminant associated print defect issue described in the preceding, there exists a need for an improved curl-free imaging member design. To achieve this purpose, the improved charge transport layer(s) of the present embodiments: (a) gives better imaging member flatness outcome (b) allows incorporation of plasticizer in any suitable loading level in the charge transport layer material matrix to impart greater electrical stability and maximize curl control, and (c) also renders the charge transport layer with resistivity to amine species attack for effecting the resolution of current pre-printed paper ghosting image defects copy printout issue.

Conventional electrophotographic imaging members and photoreceptors are disclosed in the following patents, a number of which describe the presence of light scattering particles in the undercoat layers: U.S. Pat. No. 5,660,961; U.S. Pat. No. 5,215,839; and U.S. Pat. No. 5,958,638. The term "photoreceptor" or "photoconductor" is generally used interchangeably with the terms "imaging member." The term "electrostatographic" includes "electrophotographic" and "xerographic." The terms "charge transport molecule" are generally used interchangeably with the terms "hole transport molecule."

SUMMARY

According to embodiments illustrated herein, there is provided flexible electrophotographic imaging members which have improved imaging layer(s) formulated to comprise of a plasticizer in a material matrix of a solid solution comprising a charge transporting compound and a film forming polymer binder which is a novel A-B diblock copolymer or a binary polymer blend of a novel A-B diblock copolymer and a conventional bisphenol polycarbonate.

In particular, the present embodiments provide an imaging member comprising: a flexible substrate; a charge generating layer disposed on the substrate; and at least one charge transport layer disposed on the charge generating layer, wherein the charge transport layer comprises at least one liquid plasticizing compound in a solid solution further comprising a diamine charge transport component, and a polycarbonate binder, wherein the polycarbonate binder is an A-B diblock copolymer comprising two segmental blocks of a bisphenol A carbonate ($C_{16}H_{14}O_3$) block (A) and a phthalic acid containing terminal block (B) capable of providing protection against amine species contaminants, and further wherein the imaging member does not include an anticurl back coating layer.

Further embodiments provide an imaging member comprising: a flexible substrate; a charge generating layer disposed on the substrate; and a dual-layer charge transport layer including a bottom charge transport layer disposed on the charge generating layer and a top exposed charge transport layer disposed on the bottom charge transport layer, wherein each layer of the dual-layer charge transport layer comprises at least one liquid plasticizing compound present in the same weight percent in a solid solution further comprising a diamine charge transport component, and a polycarbonate binder, wherein the polycarbonate binder is an A-B diblock copolymer comprising two segmental blocks of a bisphenol A polycarbonate ($C_{16}H_{14}O_3$) and a phthalic acid, and further wherein the imaging member does not include an anticurl back coating layer.

Other embodiments provide an imaging member comprising: a flexible substrate; a charge generating layer disposed on the substrate; and a multiple-layer charge transport layer including a bottom charge transport layer disposed on the charge generating layer, a plurality of middle charge transport layers disposed on the bottom charge transport layer, and a top exposed charge transport layer disposed on the plurality of middle charge transport layers, wherein each of layer of the multiple-layer charge transport layer comprises at least one liquid plasticizing compound present in the same weight percent in a solid solution further comprising a diamine charge transport component, and a polycarbonate binder, wherein the polycarbonate binder is an A-B diblock copolymer comprising two segmental blocks of a bisphenol A polycarbonate ($C_{16}H_{14}O_3$) and a phthalic acid, and further wherein the imaging member does not include an anticurl back coating layer.

Yet other embodiments provide an image forming apparatus for forming images on a recording medium comprising: a) an imaging member having a charge retentive-surface for receiving an electrostatic latent image thereon, wherein the imaging member comprises a flexible substrate; a charge generating layer disposed on the substrate; and at least one charge transport layer disposed on the charge generating layer, wherein the charge transport layer comprises at least one liquid plasticizing compound in a solid solution further comprising a diamine charge transport component being N,N'-diphenyl-N,N'-bis(3-methylphenyl)-1,1'-biphenyl-4,4'-diamine, and a polycarbonate binder, wherein the polycarbonate binder is an A-B diblock copolymer comprising two segmental blocks of a bisphenol A polycarbonate ($C_{16}H_{14}O_3$) and a phthalic acid capable of providing protection against amine species contaminants, and further wherein the imaging member does not include an anticurl back coating layer; b) a development component for applying a developer material to the charge-retentive surface to develop the electrostatic latent image to form a developed image on the charge-retentive surface; c) a transfer component for transferring the developed image from the charge-retentive surface to a copy substrate; and d) a fusing component for fusing the developed image to the copy substrate.

BRIEF DESCRIPTION OF THE DRAWINGS

For a better understanding of the details of present disclosure, reference may be had to the accompanying figures.

DETAILED DESCRIPTION

Figure 1:
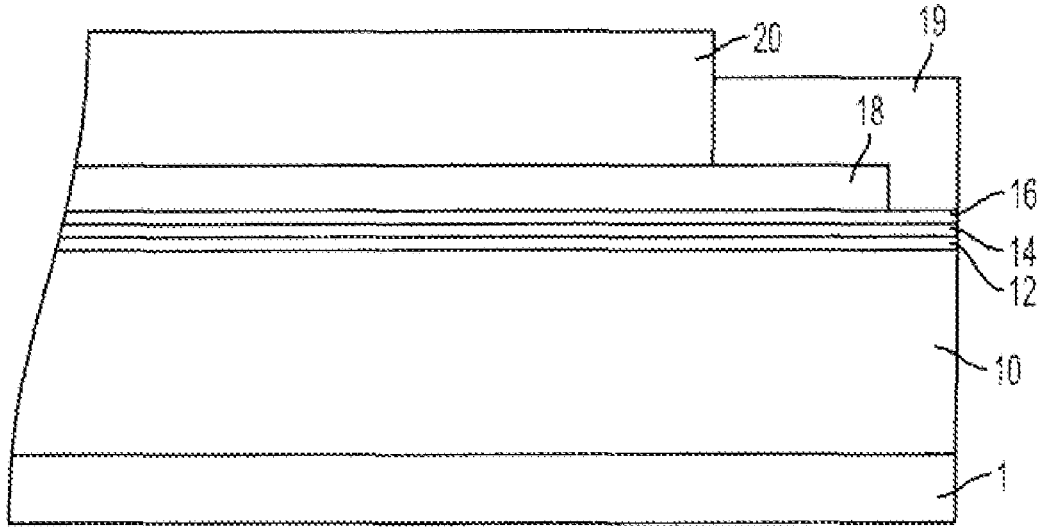
FIG. 1 PRIOR ART
FIG. 1 is a cross-sectional view of a conventional prior art flexible multilayered electrophotographic imaging member.

In the following description, reference is made to the accompanying drawings, which form a part hereof and which illustrate several embodiments. It is understood that other embodiments may be utilized and structural and operational changes may be made without departure from the scope of the present embodiments.

According to aspects illustrated herein, there is provided a flexible anticurl back coating-free multilayered electrophotographic imaging members prepared according to the present disclosure. This flexible anticurl back coating-free imaging member is prepared to comprise a flexible substrate, a charge generating layer disposed on the substrate, and at least one charge transport layer redesigned according to the present disclosure formulation disposed on the charge generating layer, wherein the charge transport layer comprises, a plasticizer, a solid solution of N,N'-diphenyl-N,N'-bis(3-methylphenyl)-1,1-biphenyl-4,4'-diamine charge transport compound and a polymer binder which in one embodiment: (1) is only a film forming A-B diblock copolymer derived from a bisphenol A polycarbonate modified to contain about 10 mole percent of a phthalic acid containing block at the terminal end of the main polycarbonate chain; and in a second embodiment (2) is a binary polymer binder comprising a blend of the A-B diblock copolymer and a conventional bisphenol polycarbonate. The plasticizer used for incorporation is a high boiler liquid being compatible with both the charge transport compound and the polymer binder or blended polymer binder to give a homogeneously plasticized charge transport layer of this disclosure.

In the example of one specific embodiment, the flexible anticurl back coating-free multilayered electrophotographic imaging member containing the charge transport layer of the present disclosure is formulated to comprise, a compatible plasticizer, and a solid solution consisting of a charge transport compound and a novel film forming A-B diblock copolymer binder. The plasticizer is a high boiler liquid being compatible with both the charge transport compound and the novel A-B diblock copolymer binder which is a modification from the bisphenol A polycarbonate of poly(4,4'-isopropylidene diphenyl carbonate) to include a phthalic acid containing segmental block B at the terminal of the bisphenol A polycarbonate back bone. Therefore, the A-B di-block copolymer is consisting of a bisphenol A polycarbonate segment block A and a phthalic acid containing segment block B, having a general molecular structure shown in Formula (I) below:

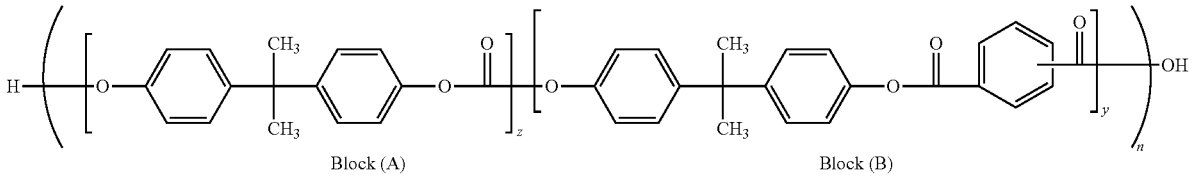

In another specific anticurl back coating-free electrophotographic imaging member example, the charge transport layer of this disclosure is again formulated to comprise, a compatible high boiler liquid plasticizer, a solid solution consisting of a charge transport compound and a likewise film forming A-B diblock copolymer binder consisting of a bisphenol A polycarbonate poly(4,4'-isopropylidene diphenyl carbonate) block A and a phthalic acid containing segmental block B at the terminal of bisphenol A polycarbonate back bone. The A-B diblock copolymer of the bisphenol A polycarbonate has a general molecular structure shown in the following Formula (II):

Formula (II)

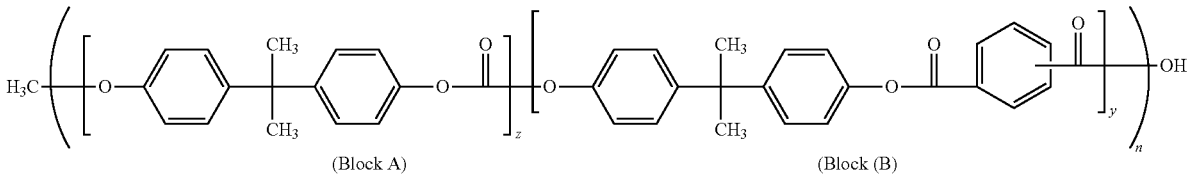

In the above Formulas (I) and (II), z represents the number of bisphenol A repeating units of block (A) and is from about 9 to about 18, y is number of repeating phthalic acid in block (B) and is from about 1 to about 2, and n is the degree of polymerization. In embodiments, the degree of polymerization of the diblock copolymer, n, is between about 20 and about 80 and the copolymer has a molecular weight of between about 100,000 and about 200,000. The phthalic acid presence in each A-B diblock copolymer molecule terminal provides an amine quenching/neutralization capability, through acid-base reaction, to resolve the current pre-printed papers ghosting defects issue observed in the xerographic printout copies.

A typical conventional negatively charged flexible electrophotographic imaging member of prior art is illustrated in FIG. 1. The substrate 10 has an optional conductive layer 12. An optional hole blocking layer 14 disposed onto the conductive layer 12 is coated over with an optional adhesive layer 16. The charge generating layer 18 is located between the adhesive layer 16 and the charge transport layer 20. An optional ground strip layer 19 operatively connects the charge generating layer 18 and the charge transport layer 20 to the conductive ground plane 12, and an anti-curl backing layer 1 is applied to the side of the substrate 10 opposite from the electrically active layers to render imaging member flatness.

The layers of the imaging member include, for example, an optional ground strip layer 19 that is applied to one edge of the imaging member to promote electrical continuity with the conductive ground plane 12 through the hole blocking layer 14. The conductive ground plane 12, which is typically a thin metallic layer, for example a 10 nanometer thick titanium coating, may be deposited over the substrate 10 by vacuum deposition or sputtering process. The other layers 14, 16, 18, 20 and 43 are to be separately and sequentially deposited, onto to the surface of conductive ground plane 12 of substrate 10 respectively, as wet coating layer of solutions comprising a solvent, with each layer being dried before deposition of the next subsequent one. An anticurl back coating layer 1 may then be formed on the backside of the support substrate 1. The anticurl back coating 1 is also solution coated, but is applied to the back side (the side opposite to all the other layers) of substrate 1, to render imaging member flatness.

The Substrate

The imaging member support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and or oxides.

The support substrate 10 can also be formulated entirely of an electrically conductive material, or it can be an insulating material including inorganic or organic polymeric materials, such as, MYLAR, a commercially available biaxially oriented polyethylene terephthalate (PET) from DuPont, or polyethylene naphthalate (PEN) available as KALEDEX 2000, with a ground plane layer comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations. The substrate may have a number of many different configurations, such as, for example, a plate, a drum, a scroll, an endless flexible belt, and the like. In one embodiment, the substrate is in the form of a seamed flexible belt.

The thickness of the support substrate 10 depends on numerous factors, including flexibility, mechanical performance, and economic considerations. The thickness of the support substrate may range from about 50 micrometers to about 3,000 micrometers. In embodiments of flexible imaging member belt preparation, the thickness of substrate used is from about 50 micrometers to about 200 micrometers for achieving optimum flexibility and to effect tolerable induced imaging member belt surface bending stress/strain when a belt is cycled around small diameter rollers in a machine belt support module, for example, the 19 millimeter diameter rollers.

An exemplary functioning support substrate 10 is not soluble in any of the solvents used in each coating layer solution, has good optical transparency, and is thermally stable up to a high temperature of at least 150° C. A typical support substrate 10 used for imaging member fabrication has a thermal contraction coefficient ranging from about $1\times10^{-5}$/° C. to about $3\times10^{-5}$/° C. and a Young's Modulus of between about $5\times10^{-5}$ psi ($3.5\times10^{-4}$ Kg/cm2) and about $7\times10^{-5}$ psi ($4.9\times10^{-4}$ Kg/cm2).

The Conductive Ground Plane

The conductive ground plane layer 12 may vary in thickness depending on the optical transparency and flexibility desired for the electrophotographic imaging member. For a typical flexible imaging member belt, it is desired that the thickness of the conductive ground plane 12 on the support substrate 10, for example, a titanium and/or zirconium conductive layer produced by a sputtered deposition process, is in the range of from about 2 nanometers to about 75 nanometers to effect adequate light transmission through for proper back erase. In particular embodiments, the range is from about 10 nanometers to about 20 nanometers to provide optimum combination of electrical conductivity, flexibility, and light transmission. For electrophotographic imaging process employing back exposure erase approach, a conductive ground plane light transparency of at least about 15 percent is generally desirable. The conductive ground plane need is not limited to metals. Nonetheless, the conductive ground plane 12 has usually been an electrically conductive metal layer which may be formed, for example, on the substrate by any suitable coating technique, such as a vacuum depositing or sputtering technique. Typical metals suitable for use as conductive ground plane include aluminum, zirconium, niobium, tantalum, vanadium, hafnium, titanium, nickel, stainless steel, chromium, tungsten, molybdenum, combinations thereof, and the like. Other examples of conductive ground plane 12 may be combinations of materials such as conductive indium tin oxide as a transparent layer for light having a wavelength between about 4000 Angstroms and about 9000 Angstroms or a conductive carbon black dispersed in a plastic binder as an opaque conductive layer. However, in the event where the entire substrate is chosen to be an electrically conductive metal, such as in the case that the electrophotographic imaging process designed to use front exposure erase, the outer surface thereof can perform the function of an electrically conductive ground plane so that a separate electrical conductive layer 12 may be omitted.

For the reason of convenience, all the illustrated embodiments herein after will be described in terms of a substrate layer 10 comprising an insulating material including organic polymeric materials, such as, polyethylene terephthalate (PET) or polyethylene naphthalate (PEN) having a conductive ground plane 12 comprising of an electrically conductive material, such as titanium or titanium/zirconium, coating over the support substrate 10.

The Hole Blocking Layer

A hole blocking layer 14 may then be applied to the conductive ground plane 12 of the support substrate 10. Any suitable positive charge (hole) blocking layer capable of forming an effective barrier to the injection of holes from the adjacent conductive layer 12 into the overlaying photoconductive or photogenerating layer may be utilized. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may comprise nitrogen containing siloxanes or silanes, or nitrogen containing titanium or zirconium compounds, such as, titanate and zirconate. The hole blocking layer 14 may have a thickness in wide range of from about 5 nanometers to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (gamma-aminobutyl)methyl diethoxysilane which has the formula [H2N(CH2)4]CH3Si(OCH3)2, and (gamma-aminopropyl) methyl diethoxysilane, which has the formula [H2N(CH2)3] CH33Si(OCH3)2, and combinations thereof, as disclosed, for example, in U.S. Pat. Nos. 4,338,387; 4,286,033; and 4,291,110, incorporated herein by reference in their entireties. A specific hole blocking layer comprises a reaction product between a hydrolyzed silane or mixture of hydrolyzed silanes and the oxidized surface of a metal ground plane layer. The oxidized surface forms on the outer surface of most metal ground plane layers when exposed to air after deposition. This combination enhances electrical stability at low RH. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly (2-hydroxyethyl methacrylate) blended with the parent polymer poly (2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of these U.S. Patents are incorporated herein by reference in their entireties.

The hole blocking layer 14 can be continuous or substantially continuous and may have a thickness of less than about 10 micrometers because greater thicknesses may lead to undesirably high residual voltage. In aspects of the exemplary embodiment, a blocking layer of from about 0.005 micrometers to about 2 micrometers gives optimum electrical performance. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of between about 0.05:100 to about 5:100 is satisfactory for spray coating.

The Adhesive Interface Layer

An optional separate adhesive interface layer 16 may be provided. In the embodiment illustrated in FIG. 1, an interface layer 16 is situated intermediate the blocking layer 14 and the charge generator layer 18. The adhesive interface layer 16 may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-1200, VITEL PE-2200, VITEL PE-2200D, and VITEL PE-2222, all from Bostik, 49,000 polyester from Rohm Hass, polyvinyl butyral, and the like. The adhesive interface layer 16 may be applied directly to the hole blocking layer 14. Thus, the adhesive interface layer 16 in embodiments is in direct contiguous contact with both the underlying hole blocking layer 14 and the overlying charge generator layer 18 to enhance adhesion bonding to provide linkage. However, in some alternative electrophotographic imaging member designs, the adhesive interface layer 16 is entirely omitted.

Any suitable solvent or solvent mixtures may be employed to form a coating solution of the polyester for the adhesive interface layer 36. Typical solvents include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer 16 may have a thickness of from about 0.01 micrometers to about 900 micrometers after drying. In embodiments, the dried thickness is from about 0.03 micrometers to about 1 micrometer.

The Charge Generating Layer

The photogenerating (e.g., charge generating) layer 18 may thereafter be applied to the adhesive layer 16. Any suitable charge generating binder layer 18 including a photogenerating/photoconductive material, which may be in the form of particles and dispersed in a film forming binder, such as an inactive resin, may be utilized. Examples of photogenerating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. The photogenerating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the photogenerating layer 18, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like.

An exemplary film forming polymer binder is PCZ-400 (poly(4,4'-dihydroxy-diphenyl-1-1-cyclohexane) which has a molecular weight of about 40,000 and is available from Mitsubishi Gas Chemical Corporation.

The photogenerating material can be present in the resinous binder composition in various amounts. Generally, from about 5 percent by volume to about 90 percent by volume of the photogenerating material is dispersed in about 10 percent by volume to about 95 percent by volume of the resinous binder, and more specifically from about 20 percent by volume to about 30 percent by volume of the photo generating material is dispersed in about 70 percent by volume to about 80 percent by volume of the resinous binder composition.

The photogenerating layer 18 containing the photogenerating material and the resinous binder material generally ranges in thickness of from about 0.1 micrometer to about 5 micrometers, for example, from about 0.3 micrometers to about 3 micrometers when dry. The photogenerating layer thickness is generally related to binder content. Higher binder content compositions generally employ thicker layers for photogeneration.

The Ground Strip Layer

Other layers such as conventional ground strip layer 19 including, for example, conductive particles dispersed in a film forming binder may be applied to one edge of the imaging member to promote electrical continuity with the conductive ground plane 12 through the hole blocking layer 14. Ground strip layer may include any suitable film forming polymer binder and electrically conductive particles. Typical ground strip materials include those enumerated in U.S. Pat. No. 4,664,995, the entire disclosure of which is incorporated by reference herein. The ground strip layer 19 may have a thickness from about 7 micrometers to about 42 micrometers, for example, from about 14 micrometers to about 23 micrometers.

The Charge Transport Layer

The charge transport layer 20 is thereafter applied over the charge generating layer 18 and become, as shown in FIG. 1, the exposed outermost layer of the imaging member. It may include any suitable transparent organic polymer or non-polymeric material capable of supporting the injection of photogenerated holes or electrons from the charge generating layer 18 and capable of allowing the transport of these holes/electrons through the charge transport layer to selectively discharge the surface charge on the imaging member surface. In one embodiment, the charge transport layer 20 not only serves to transport holes, but also protects the charge generating layer 18 from abrasion or chemical attack and may therefore extend the service life of the imaging member. The charge transport layer 20 can be a substantially non-photoconductive material, but one which supports the injection of photogenerated holes from the charge generation layer 18. The charge transport layer 20 is normally transparent in a wavelength region in which the electrophotographic imaging member is to be used when exposure is effected therethrough to ensure that most of the incident radiation is utilized by the underlying charge generating layer 18. The charge transport layer should exhibit excellent optical transparency with negligible light absorption and neither charge generation nor discharge if any, when exposed to a wavelength of light useful in xerography, e.g., 400 to 900 nanometers. In the case when the imaging member is prepared with the use of a transparent support substrate 10 and also a transparent conductive ground plane 12, image wise exposure or erase may be accomplished through the substrate 10 with all light passing through the back side of the support substrate 10. In this particular case, the materials of the charge transport layer 20 need not have to be able to transmit light in the wavelength region of use for electrophotographic imaging processes if the charge generating layer 18 is sandwiched between the support substrate 10 and the charge transport layer 20. In all events, the exposed outermost charge transport layer 20 in conjunction with the charge generating layer 18 is an insulator to the extent that an electrostatic charge deposited/placed over the charge transport layer is not conducted in the absence of radiant illumination. Importantly, the charge transport layer 20 should trap minimal or no charges as the charge pass through it during the image copying/printing process.

The charge transport layer 20 may include any suitable charge transport component or activating compound useful as an additive molecularly dispersed in an electrically inactive polymeric material to form a solid solution and thereby making this material electrically active. The charge transport component may be added to a film forming polymeric material which is otherwise incapable of supporting the injection of photo generated holes from the generation material and incapable of allowing the transport of these holes there through. This converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The charge transport component typically comprises small molecules of an organic compound which cooperate to transport charge between molecules and ultimately to the surface of the charge transport layer.

Any suitable inactive film-forming resin binder soluble in methylene chloride, chlorobenzene, or other suitable solvent may be employed in the charge transport layer. Exemplary binders include polyesters, polyvinyl butyrals, polycarbonate, polystyrene, polyvinyl formals, and combinations thereof. The polymer binder used for the charge transport layers may be, for example, selected from the group consisting of polycarbonates, poly(vinyl carbazole), polystyrene, polyester, polyarylate, polyacrylate, polyether, polysulfone, combinations thereof, and the like. Exemplary polycarbonates include the bisphenol A polycarbonate of poly(4,4'-isopropylidene diphenyl carbonate), poly(4,4'-diphenyl-1,1'-cyclohexane carbonate), and combinations thereof. The molecular weight of the bisphenol A polycarbonate binder 24 used in the charge transport layer can be, for example, from about 20,000 to about 200,000.

Exemplary charge transport components include aromatic polyamines, such as aryl diamines and aryl triamines. Exemplary aromatic diamines include N,N'-diphenyl-N,N'-bis(alkylphenyl)-1,1'-biphenyl-4,4-diamines, such as mTBD, which has the formula (N,N'-diphenyl-N,N'-bis[3-methylphenyl]-[1,1'-biphenyl]-4,4'-diamine); N,N'-diphenyl-N,N'-bis(chlorophenyl)-1,1'-biphenyl-4,4'-diamine; and N,N'-bis-(4-methylphenyl)-N,N'-bis(4-ethylphenyl)-1,1'-3,3'-dimethylbiphenyl)-4,4'-diamine (Ae-16), N,N'-bis-(3,4-dimethylphenyl)-4,4'-biphenyl amine (Ae-18), and combinations thereof.

Other suitable charge transport components include pyrazolines, such as 1-[lepidyl-(2)]-3-(p-diethylaminophenyl)-5-(p-diethylaminophenyl)pyrazoline, as described, for example, in U.S. Pat. Nos. 4,315,982, 4,278,746, 3,837,851, and 6,214,514, substituted fluorene charge transport molecules, such as 9-(4'-dimethylaminobenzylidene)fluorene, as described in U.S. Pat. Nos. 4,245,021 and 6,214,514, oxadiazole transport molecules, such as 2,5-bis(4-diethylaminophenyl)-1,3,4-oxadiazole, pyrazoline, imidazole, triazole, as described, for example in U.S. Pat. No. 3,895,944, hydrazones, such as p-diethylaminobenzaldehyde (diphenylhydrazone), as described, for example in U.S. Pat. Nos. 4,150,987 4,256,821, 4,297,426, 4,338,388, 4,385,106, 4,387,147, 4,399,207, 4,399,208, 6,124,514, and tri-substituted methanes, such as alkyl-bis(N,N-dialkylaminoaryl)methanes, as described, for example, in U.S. Pat. No. 3,820,989. The disclosures of all of these patents are incorporated herein be reference in their entireties.

The concentration of the charge transport component in layer 20 may be, for example, at least about 10 weight percent and may comprise from about 10 to about 90 weight percent. The concentration or composition of the charge transport component may vary through layer 20, as disclosed, for example, in U.S. Pat. No. 7,033,714; U.S. Pat. No. 6,933,089; and U.S. Pat. No. 7,018,756, the disclosures of which are incorporated herein by reference in their entireties.

In one exemplary formulation, the charge transport layer 20 comprises an average of about 20 to about 80 weight percent N,N'-diphenyl-N,N'-bis(3-methylphenyl)-1,1'-biphenyl-4,4'-diamine, or from about 30 to about 50 weight percent N,N'-diphenyl-N,N'-bis(3-methylphenyl)-1,1'-biphenyl-4,4'-diamine.

The charge transport layer 20 is an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer 20 to the charge generator layer 18 is maintained from about 2:1 to about 200:1 and in some instances as great as about 400:1.

Additional aspects relate to the inclusion in the charge transport layer 20 of variable amounts of an antioxidant, such as a hindered phenol. Exemplary hindered phenols include octadecyl-3,5-di-tert-butyl-4-hydroxyhydrociannamate, available as IRGANOX I-1010 from Ciba Specialty Chemicals. The hindered phenol may be present at about 10 weight percent based on the concentration of the charge transport component. Other suitable antioxidants are described, for example, in above-mentioned U.S. application Ser. No. 10/655,882 incorporated by reference.

In one specific formulation, the charge transport layer 20 is a solid solution consisting of a charge transport compound, such as N,N'-diphenyl-N,N'-bis(3-methylphenyl)-1,1'-biphenyl-4,4'-diamine, molecularly dissolved in a polycarbonate binder, the binder being either a bisphenol A polycarbonate of poly(4,4'-isopropylidene diphenyl carbonate) or a bisphenol Z polycarbonate of poly(4,4'-diphenyl-1,1'-cyclohexane carbonate). The bisphenol A polycarbonate used for typical charge transport layer formulation is available under the tradename FPC0170, having a molecular weight of about 120,000 and commercially available from Mitsubishi Chemicals Corp. The molecular structure of bisphenol A polycarbonate, poly(4,4'-isopropylidene diphenyl carbonate), is given in Formula (A) below:

Formula (A)

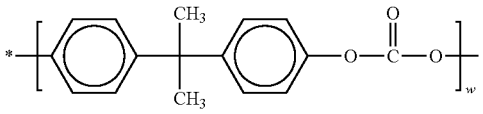

wherein w indicates the degree of polymerization.

The charge transport layer 20 may have between about 10 and about 50 micrometers in thickness, or between about 20 and about 40 micrometers. The typical charge transport layer has a Young's Modulus in the range of from about 2.5×10-5 psi (1.7×10-4 Kg/cm2) to about 4.5×10-5 psi (3.2×10-4 Kg/cm2) and a thermal contraction coefficient of between about 6×10-5° C. and about 8×10-5° C.

In the present disclosure, the material composition of a charge transport layer is reformulated to give two distinctive designs comprising, namely: (I) a liquid plasticizer incorporated into a solid solution which comprises a diamine charge transport compound and a novel organic acid terminated A-B diblock binder and (II) a liquid plasticizer incorporated into a solid solution of a diamine charge transport compound and a binary polymer binder comprising a polymer blend of the novel A-B diblock copolymer and a conventional bisphenol polycarbonate. The incorporation of a specifically selected plasticizer in the charge transport layer has been demonstrated to effect the layer's internal stress/strain relief to render imaging member flatness control. The resulting imaging member thus obtained, having no anticurl back coating, has absolute flatness, is electrically stable with tune-ability, and may also potentially resolve the pre-printed paper ghosting defect copy printout issues.

The Single Charge Transport Embodiments

Figure 2:
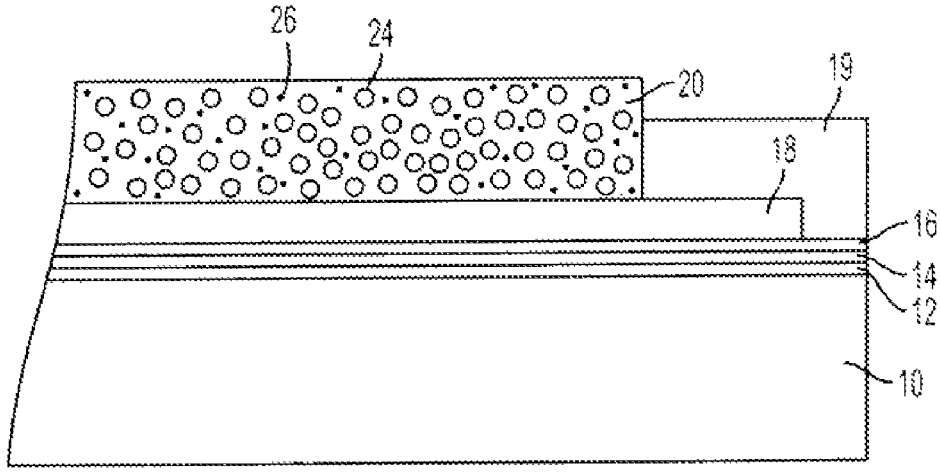
FIG. 2 is a cross-sectional view of a flexible anticurl back coating-free multilayered electrophotographic imaging member having a single charge transport layer of this disclosure according to the present embodiments.

FIG. 2 discloses an anticurl back coating-free flexible imaging member, prepared according to the material formulation and methodology of the present disclosure, that includes a plasticized stress/strain relieved charge transport layer designed to effect imaging member curl elimination and also contain a chemical component which is resistive against amine species attack. In this embodiment, the substrate 10, conductive ground plane 12, hole blocking layer, 14, adhesive interface layer 16, charge generating layer 18, ground strip layer 16, and charge transport layer 20 are all prepared to comprise of the same materials, compositions, thicknesses, and follow the identical procedures as those described in the conventional imaging member of FIG. 1, but with the exception that the charge transport layer 20 is then an improved layer which is redesigned according to present disclosure to give photo-electrical and mechanical functions enhancements as well as chemical resistivity. This is achieved through utilizing a novel film forming A-B diblock copolymer binder 24 and the incorporation of a high boiler liquid plasticizer 26 to impart internal stress/strain relief for effective imaging member flatness control without the need of an anticurl back coating. According to aspects shown in FIG. 2 and illustrated herein, there is provided a flexible anticurl back coating-free electrophotographic imaging member, comprising a flexible substrate 10, a conductive ground plane 12, a hole blocking layer, 14, an adhesive interface layer 16, a charge generating layer 18 disposed on the adhesive interface layer 16, a ground strip layer 16, and a plasticized charge transport layer 20 of present disclosure disposed on the charge generating layer 18. The charge transport layer 20 is formulated according to present disclosure to comprise a compatible liquid plasticizer 26, a solid solution consisting of a charge transport compound of N,N'-diphenyl-N,N'-bis(3-methylphenyl)-1,1-biphenyl-4,4'-diamine and a novel A-B diblock copolymer binder 24. The novel copolymer binder 24 is a film forming A-B diblock copolymer which is created by modifying the bisphenol A polycarbonate poly(4,4'-isopropylidene diphenyl carbonate) to include a phthalic acid containing segmental block at the terminal of the bisphenol A polycarbonate backbone to give the molecular structures described in preceding Formulas (I) and (II).

In another embodiment of a flexible anticurl back coating-free electrophotographic imaging member, the plasticized single charge transport layer 20 of the present disclosure shown in FIG. 2 is a formulation which comprises a plasticizer 26 and a solid solution consisting of a charge transport compound and the novel film forming A-B diblock copolymer binder 24; the copolymer binder is created by modifying the bisphenol A polycarbonate of poly(4,4'-isopropylidene diphenyl carbonate) to include a phthalic acid containing segmental block at the terminal of bisphenol A polycarbonate back bone. Thus, the A-B diblock copolymer comprises a bisphenol A polycarbonate segment block A which is linked to a phthalic acid containing segment block B, having a general molecular structure shown in Formula (I) below:

Formula (I)

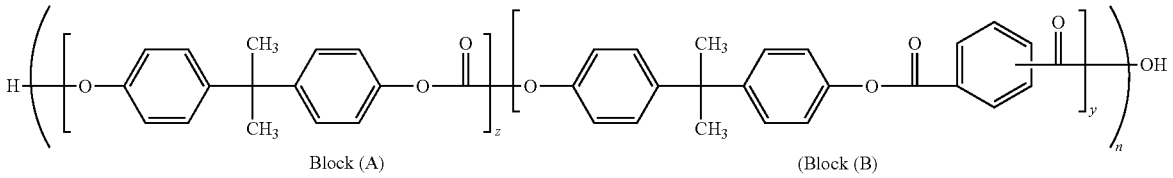

In another specific flexible anticurl back coating-free electrophotographic imaging member embodiment, the disclosed plasticized single charge transport layer 20 is again formulated to comprise, a compatible liquid plasticizer and a solid solution of a charge transport compound and a film forming A-B diblock copolymer binder 24 comprising bisphenol A polycarbonate poly(4,4'-isopropylidene diphenyl carbonate) block A and a phthalic acid containing segmental block B at the terminal of bisphenol A polycarbonate back bone. The A-B diblock copolymer 24 of the bisphenol A polycarbonate has a variant general molecular structure shown in the following Formula (II):

Formula (II)

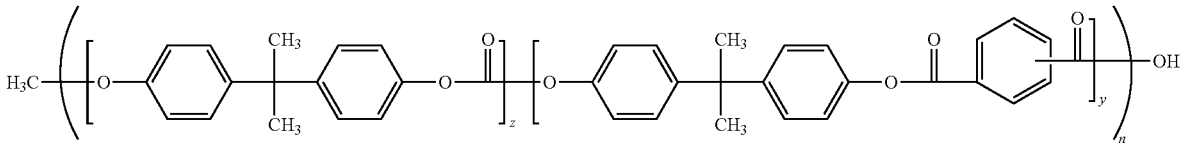

Block (A) Block (B)

In both above two formulas, z represents the number of bisphenol A repeating units in block A and is from about 9 to about 18, y is number of repeating phthalic acid block B and is from about 1 to about 2, and n is the degree of polymerization. In embodiments, the degree of polymerization, n, is between about 20 and about 80 of the diblock copolymer having molecular weight between about 100,000 and about 200,000.

The plasticized single charge transport layer 20 of the anticurl back coating-free imaging member thus prepared has a thickness from about 20 micrometers to about 40 micrometers and comprises of from about 10 to about 90 weight percent charge transport compound N,N'-diphenyl-N,N'-bis(3-methylphenyl)-1,1'-biphenyl-4,4'-diamine, or from about 20 to about 80 weight percent N,N'-diphenyl-N,N'-bis(3-methylphenyl)-1,1'-biphenyl-4,4'-diamine based on the combined weight of the charge transport compound and the polymer binder in the layer 20.

The specific A-B diblock copolymer chosen as binder to meet the present anticurl back coating-free flexible imaging member charge transport layer 20 plasticization requirement is LEXAN HLX polymer available from Sabic Innovative Plastics. Since the LEXAN HLX (as described in the above Formulas (I) and (II)) is a bisphenol A polycarbonate/phthalic acid film forming copolymer and has the physical/mechanical/chemical/thermal properties equivalent to those of the conventional polycarbonate counterpart used as charge transport layer binder in the conventional imaging members, so utilization of it for charge transport layer formulation in this disclosure is a direct and simple approach. The key benefits of choosing LEXAN HLX polymer for charge transport layer 20 binder application, to be emphasized here, are based on the fact that it: (a) is compatibility with both charge transport compound and plasticizer to form homogeneous plasticized layer and also (b) has the capability of the phthalic acid terminal in the copolymer to provide amine species quenching/neutralization effect for absolute elimination of the root cause of copy ghosting defects printout problem. Since the novel film forming A-B diblock copolymer, being a polycarbonate, is derived/modified from bisphenol A polycarbonate structure by the inclusion of small fraction of phthalic acid into the polymer backbone, the resulting copolymer contains about 90 mole percent of a bisphenol A segment block (A) linearly linking to about 10 mole percent of a segmental block (B) of phthalic acid terminal in the A-B diblock copolymer chain. However, to extend present disclosure coverage of using the A-B diblock copolymer for curl free imaging member preparation, the copolymer used for charge transport layer formulation may further include structural variances of the A-B diblock copolymer of Formulas (I) and (II), through the replacement of the bisphenol A segmental block (A) in the copolymer by each of the following types of carbonates selected to consist of:

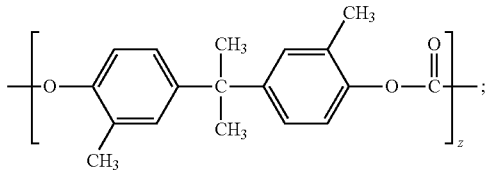

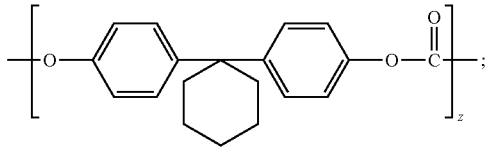

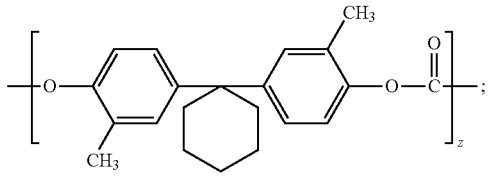

and

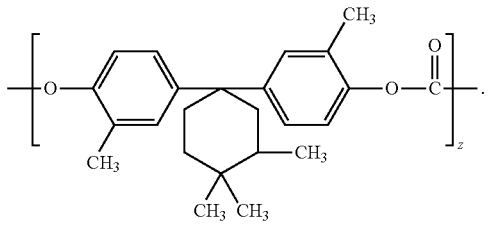

In the further extended embodiments of this disclosure shown in FIG. 2, the phthalic acid terminal block (B) linkage in the A-B diblock copolymer molecule of both Formulas (I) and (II) may also be replaced by one of the selected groups consisting of:

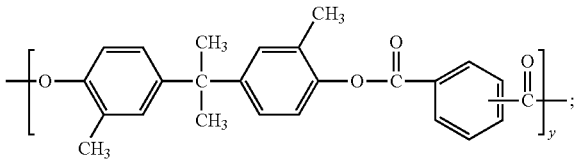

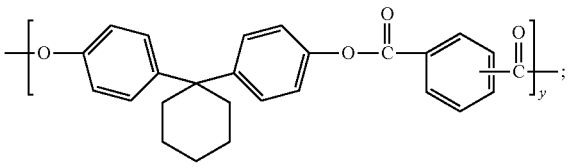

-continued

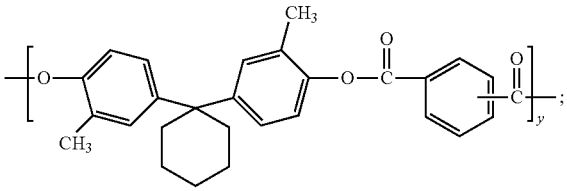

and

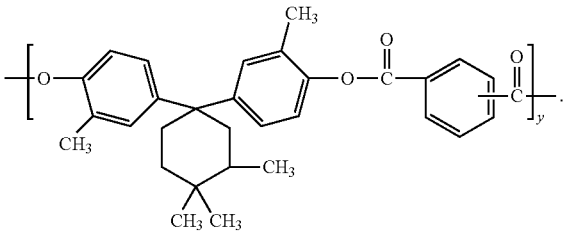

Additionally, the phthalic acid terminal block (B) in the A-B diblock copolymer may be replaced with a terephthalic acid, an isophthalic acid represented by the following, respectively:

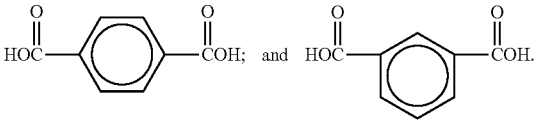

Or alternatively by an adipic acid or an azelaic acid shown below:

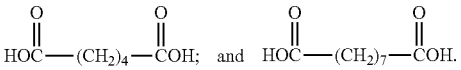

In the disclosed plasticized single charge transport layer 20 comprising the charge transport compound and the novel A-B diblock copolymer binder does also incorporated with a plasticizer 26 to effect its internal tension stress/strain relief for imaging member curl elimination. The plasticizer 26 used to produce the disclosure result is a high boiler liquid which has a boiling point of at least 250° C. to assure its permanent presence in the layer and also compatibility with both the A-B diblock copolymer and the charge transport compound in order to produce a resulting homogeneously plasticized charge transport layer having little or no internal stress/strain. To meet these requirements, a plasticizing liquid 26 of phthalates and phthalate derivatives is selected from each of the group consisting of below molecular structures:

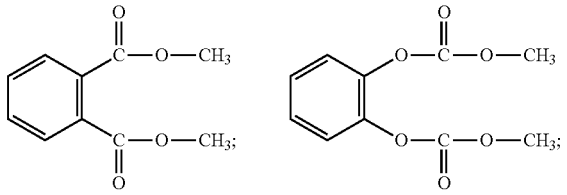

-continued

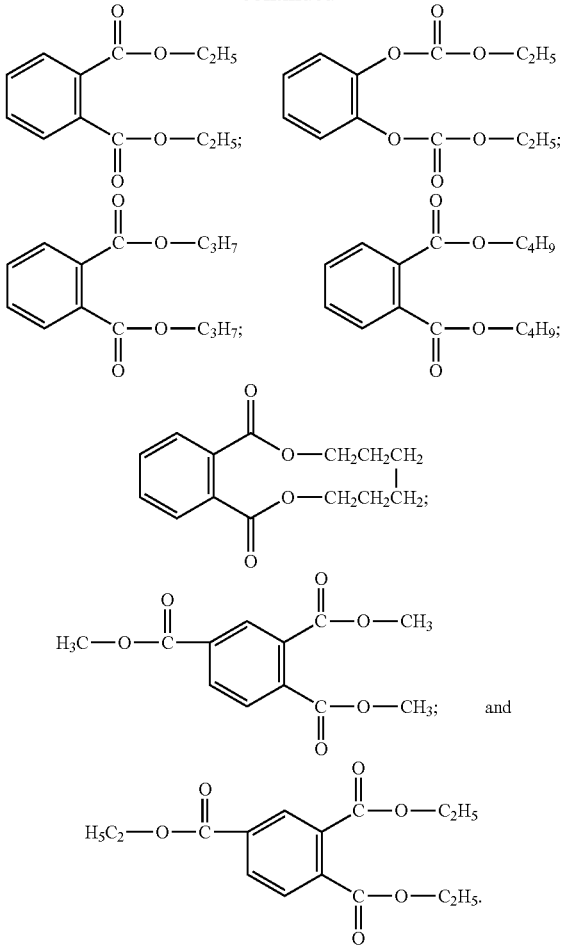

A plasticizing liquid may be selected from the diallyl terephthalate liquid and their modifications of below formulas:

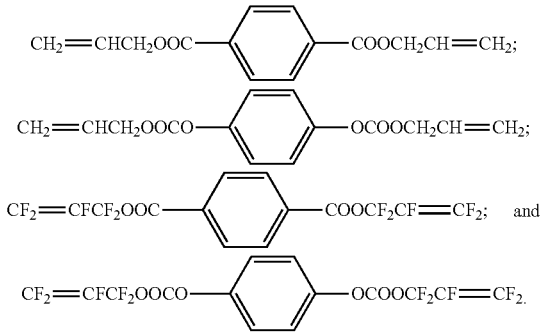

A plasticizing liquid 26 may be selected from the diallyl phthalate liquids and their modifications shown below:

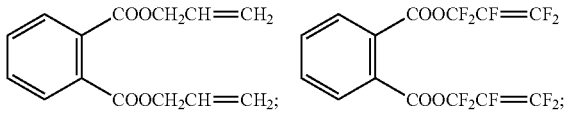

-continued

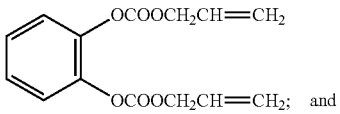

and

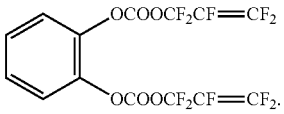

As used herein, a modified structure is one that includes a slight change to the structure as compared to other structures in its group. For example, in the above two structures, the bottom plasticizer compound has essentially the same structure as the one above it, however, the bottom plasticizer compound is modified by replacing the hydrogen atoms with fluorine atoms.

The plasticizer 26 may also be selected from one of the liquid carbonates having the molecular structures below:

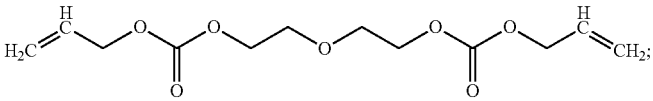

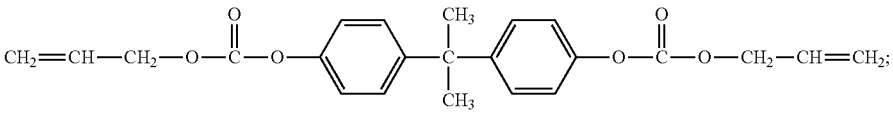

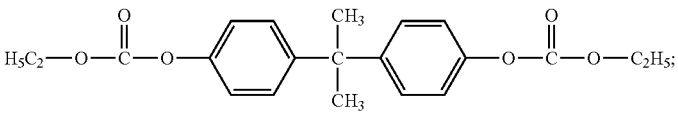

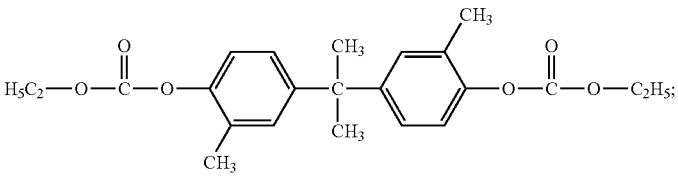

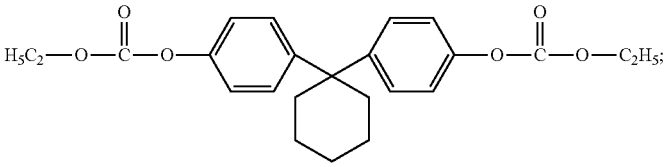

and

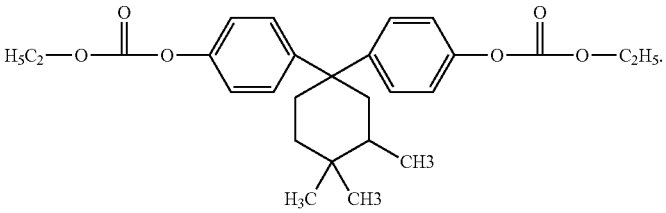

The plasticizer 26 can also be a styrene derivative having the below molecular structure:

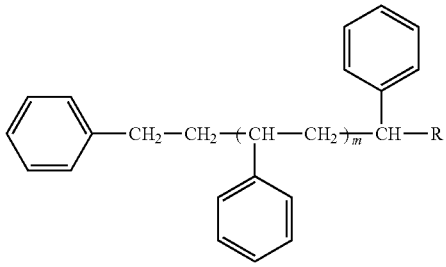

wherein R is selected from the group consisting of H, $CH_3$, $CH_2CH_3$, and $CH{=}CH_2$, and wherein m is between 0 and 3, or alternatively, have the molecular structure of:

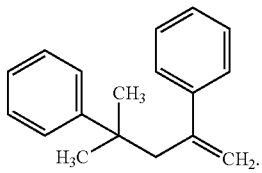

Additionally, potential plasticizer candidates suitable for use may also include dibasic alkyl ester (DBE) liquid chosen for charge transport layer 20 plasticizing application. DBE has a general molecular formula structure shown below:

$$R_1OOC(CH_2)_xCOOR_2$$

wherein x is from 1 to 10; $R_1$ and $R_2$ can be the same or different and are an alky having from about 1 to about 4 carbons, such as $CH_3$, $CH_3CH_2$, $CH_3CH_2CH_2$, $CH_3CH_2CH_2CH_2$.

Alternatively, the plasticizer 26 can further be selected from a low surface energy liquid fluoroketone, such as for example, 3-(trifluoromethyl)phenylacetone, 2'-(trifluoromethyl)propiophenone, 2,2,2-trifluoro-2',4'-dimethoxyacetophenone, 3',5'-bis(trifluoromethyl)acetophenone, 3'-(trifluoromethyl)propiophenone, 4'-(trifluoromethyl) propiophenone, 4,4,4-trifluoro-1-phenyl-1,3-butanedione, 4,4-difluoro-1-phenyl-1,3-butanedione, having the structures shown below:

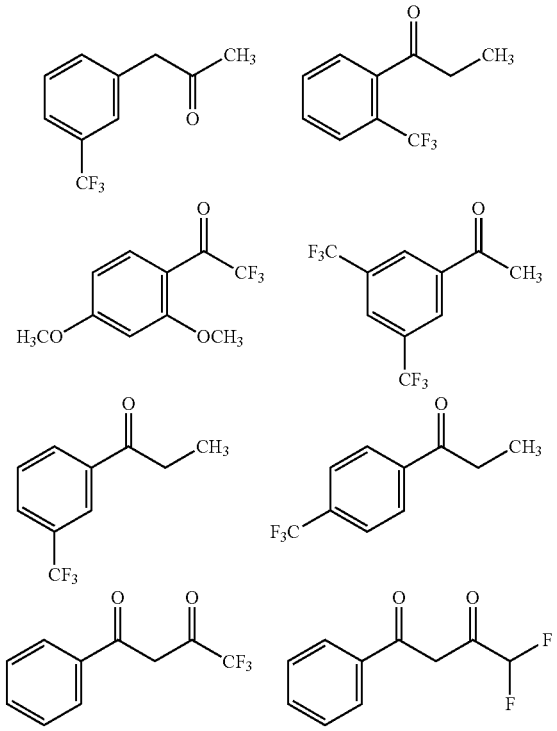

and the like and mixtures thereof.

Utilization of plasticizing liquids of fluoro-compounds such as, for example, the fluorinated phthalates or fluoroketones of those shown in the above formulas for charge transport layer incorporation does have the benefit of providing not only the intended plasticizing effect, but also renders the resulting plasticized charge transport layer with surface lubricity to ease imaging member belt cleaning and enhances toner image transfer efficiency to receiving papers as well during electrophotographic imaging and cleaning processes.

In yet another embodiment example of anticurl back coating-free imaging member of this disclosure, the plasticized single charge transport layer 20 in FIG. 2 is reformulated to comprise a high boiler liquid plasticizer 26 and a solid solution of N,N'-diphenyl-N,N'-bis(3-methylphenyl)-1,1-biphenyl-4,4'-diamine charge transport compound and a binary polymer binder 24 formed to consist of blending the novel A-B diblock copolymer binder of Formula (I) or (II) and a conventional bisphenol polycarbonate. The conventional bisphenol polycarbonates suitable for use to form the binary polymer binder 24 of polymer blending is a bisphenol polycarbonate selected from one of the following molecular Formulas of (A) to (D): a bisphenol A polycarbonate of poly(4,4'-isopropylidene diphenyl carbonate) which has a molecular structure given in Formula (A) below:

Formula (A)

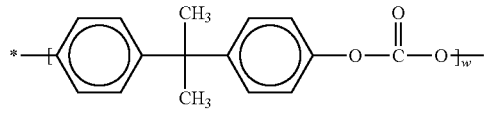

wherein w indicates the degree of polymerization; a bisphenol Z polycarbonate of poly(4,4'-diphenyl-1,1'-cyclohexane carbonate) having a Formula (B) of:

Formula (B)

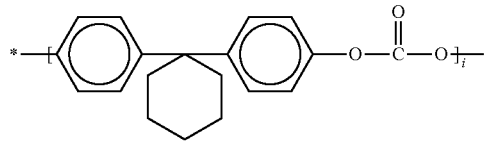

wherein i indicates the degree of polymerization; a modified bisphenol A polycarbonate of Formula (C):

Formula (C)

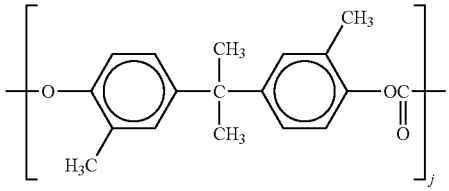

wherein j indicates the degree of polymerization; and a modified bisphenol Z polycarbonate of Formula (D):

Formula (D)

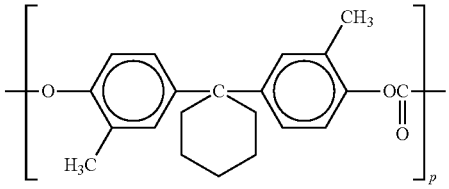

wherein p is the degree of polymerization.

The molecular weight of each of all these conventional polycarbonates of Formulas (A) to (D) is between about 60,000 and about 200,000, but preferably from about 100,000 to about 150,000 for ease of polymer solvent solubility and charge transport layer mechanical robustness consideration. The weight ratio of copolymer to polycarbonate used for forming the binary polymer blended hinder 24 is between about 5:95 and about 95:5 to effect electrical $V_e$ tuning and control.

In both the above flexible anticurl back coating-free imaging member preparation embodiments, the charge transport compound N,N'-diphenyl-N,N'-bis(3-methylphenyl)-1,1-biphenyl-4,4'-diamine presence in the resulting plasticized single charge transport layer 20 is from about 10 to about 90 weight percent, or from about 20 to about 80 weight percent, based on the combined weight of charge transport compound and the A-B copolymer (or polymer blended) binder 24 in the charge transport layer, for effecting optimum photo-electrical and mechanical performances. Though the loading level of plasticizer is from about 3 to about 15 weight percent, but preferably to be between about 5 and about 9 weight percent based on the total weight of the plasticized the charge transport layer. The resulting plasticized single charge transport layer 20 thus prepared has about 20 to about 40 micrometers in thickness, of little or no internal tension stress/strain build-up, and amine quenching/neutralization capability.

The Dual Charge Transport Embodiments

Figure 3:
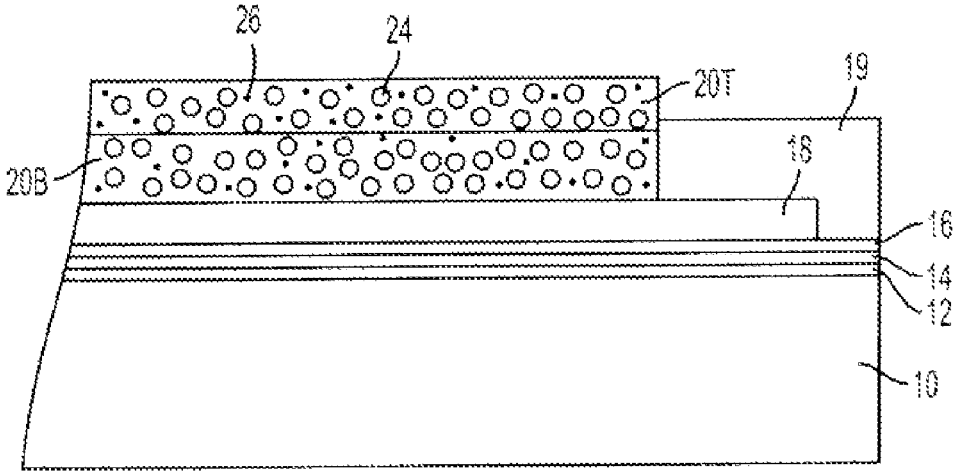
FIG. 3 is a cross-sectional view of a flexible anticurl back coating-free multilayered electrophotographic imaging member having dual charge transport layers of this disclosure according to the present embodiments.

In further extended embodiments, there are provided a flexible anticurl back coating-free imaging member, shown in FIG. 3, comprising: a flexible substrate, a charge generating layer disposed on the substrate, and plasticized dual charge transport layers disposed on the charge generating layer. This anticurl back coating-free imaging member is a derivation from that shown in FIG. 2, in which the plasticized charge transport layer 20 is redesigned to comprise dual layers: a bottom layer 20B disposed directly onto the charge generating layer 18 and an exposed top layer 20T over the bottom layer 20B. Both of these layers, as prepared, comprise the same A-B diblock copolymer binder 24 of Formulas (I) and (II), same charge transport compound of N,N'-diphenyl-N,N'-bis(3-methylphenyl)-1,1-biphenyl-4,4'-diamine, and same loading of plasticizer, but with the exception that the exposed top layer 20T contains a lesser amount of the charge transport compound than that in the bottom layer 20B to provide mechanical function enhancement.

In further extended embodiments of FIG. 3, the curl free imaging member design is likewise provided with: a flexible substrate; a charge generating layer disposed on the substrate; and plasticized dual charge transport layers. Although both these layers contain the same loading of plasticizer and N,N'-diphenyl-N,N'-bis(3-methylphenyl)-1,1-biphenyl-4,4'-diamine charge transport compound, however the binder 24 used in the exposed top layer 20T is the novel A-B diblock copolymer of Formulas (I) and (II) while that in the bottom layer 20B is then a conventional bisphenol polycarbonate binder. The conventional bisphenol polycarbonate selected for use is selected from Formulas (A) to (D) as shown above.

In an alternative embodiment, the flexible anticurl back coating-free imaging member design is also provided with: a flexible substrate; a charge generating layer disposed on the substrate; and plasticized dual charge transport layers containing the same loading of plasticizer and N,N'-diphenyl-N,N'-bis(3-methylphenyl)-1,1-biphenyl-4,4'-diamine charge transport compound in both layer, however the binder 24 in the exposed top layer 20T is a binary polymer blend comprising the novel film forming A-B diblock copolymer of Formulas (I) and (II) and a conventional bisphenol polycarbonate selected from one of Formulas (A) to (D), whereas the binder used in the bottom layer 20B is only a conventional bisphenol polycarbonate of one from Formulas (A) to (D).

In yet another alternative embodiment, the anticurl back coating-free imaging member design is further provided to comprise: a substrate; a charge generating layer disposed on the substrate; and plasticized dual charge transport layers. Both charge transport layers are formulated to comprise of the same material ingredients of plasticizer and N,N'-diphenyl-N,N'-bis(3-methylphenyl)-1,1-biphenyl-4,4'-diamine charge transport compound and binary polymer blending binder 24 of the novel A-B diblock copolymer of Formulas (I) and (II) and a conventional bisphenol polycarbonate selected from either Formula (A) or (B).

For all the plasticized dual charge transport layers of anticurl back coating-free imaging members prepared in the preceding embodiments, both these layers have same thickness and give a total thickness of between about 20 and about 40 micrometers. Also, both layers are incorporated with the same amount of plasticizer; typically, at a loading level of from about 3 to 15 weight percent, but preferably to be between about 5 and about 9 weight percent based on the total weight of the plasticized the charge transport layer to provide best curl control and maintain optimum photoelectrical function as well. Therefore, both the plasticized dual charge transport layers thus prepared according to the present disclosure have internal stress/strain relief to impact imaging member flatness, stable $V_e$ cycle-up control, and amine quenching/neutralization capability. To impact greater mechanical function enhancement, the exposed top layer 20T in each of these dual charge transport layers as prepared above contain a lesser amount of the charge transport compound than that in the bottom layer 20B. That is the charge transport compound presence in the exposed top layer is between about 20 and about 40 weight percent while that in the bottom layer is between about 60 and about 80 weight percent based on the combined weight of charge transport compound and polymer binder 24 in each respective layer for achieving optimum photo-electrical performance, greatest wear resistance, as well cracking life extension. And, in the reformulation design that the binder 24 used in one or both dual charge transport layers is a binary polymer formed from polymer blending of the novel A-B diblock copolymer and a conventional polycarbonate, the weight ratio of copolymer to polycarbonate in the polymer blended binder is between about 95:5 and about 5:95.

Figure 4:
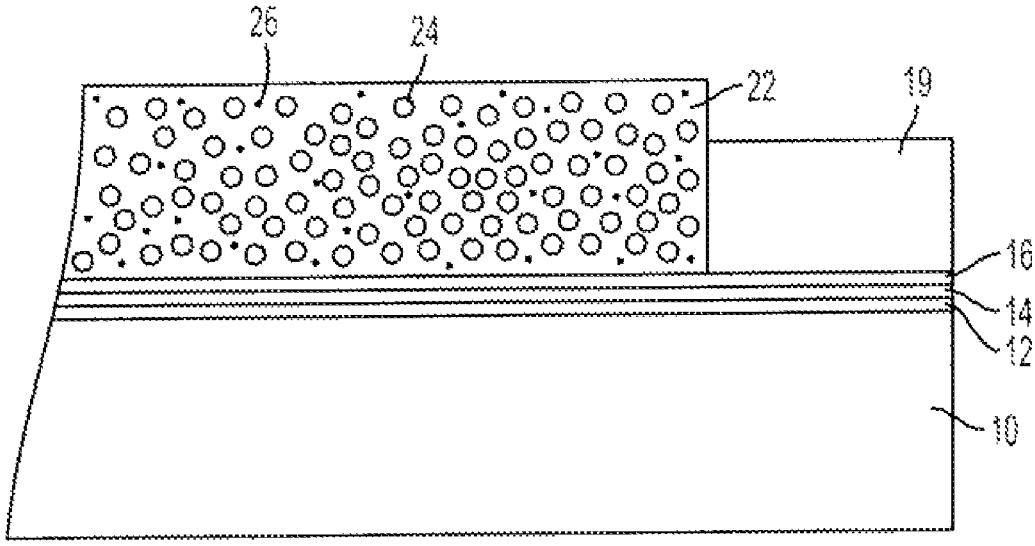
FIG. 4 is a cross-sectional view of a flexible anticurl back coating-free multilayered electrophotographic imaging member having a single charge generating/transporting layer of this disclosure according to the present embodiments.

As an alternative to the two discretely separated layers of being a charge transport 20 and a charge generation layers 18 as those described in FIG. 2, a structurally simplified flexible curl free imaging member, having all other layers being formed in the same manners as described in preceding figures, may now be designed to give a plasticized single imaging layer 22 as illustration in FIG. 4. Based on the description in the conventional electrophotographic imaging member design, the single imaging layer 22 comprises a single electrophotographically active layer capable of retaining an electrostatic charge in the dark during electrostatic charging, imagewise exposure and image development, according to U.S. Pat. No. 6,756,169, the single imaging layer 22 is then redesigned according to present disclosure to comprise of a plasticizer 26, a solid solution consisting of a charge transport compound and a binder 24 of the novel A-B diblock copolymer of Formulas (I) and (II) (otherwise, a binary polymer binder formed from blending the copolymer and a conventional bisphenol polycarbonate selected from one of Formulas (A) to (D)), and photogenerating/photoconductive material similar to those of the layer 18 described in FIG. 1. The plasticized single imaging layer 22 has a thickness of between about 20 and about 40 micrometers; it contains 20 to about 80 weight percent, or from about 30 to about 60 weight percent, based on the combined weight of charge transport compound and the copolymer binder (or polymer blended binder) in layer 22 in FIG. 4. If the binder used is binary polymer formed from blending of the novel A-B diblock copolymer and a polycarbonate, the weight ratio of copolymer to polycarbonate in the polymer blended binder is between about 95:5 and about 5:95. The amount of plasticizer 26 employed is in a loading level of from about 3 to 15 weight percent, but preferably to be between about 5 and about 9 weight percent based on the total weight of the plasticized layer 22 to provide best curl control, enhanced mechanical performance, and maintain optimum photoelectrical function as well.

In further extension to all of the above embodiments, there is also disclosed preparation descriptions of additional anticurl back coating-free imaging members to include the following extended embodiments: (1) plasticized charge transport layer (being either a single or dual layers) in each of all the anticurl back coating-free flexible imaging members detailed in the preceding will be prepared to use mixture of two different types of plasticizers selected from the list of plasticizer description. In other words, the charge transport layer of the anticurl back coating-free imaging member of each and every embodiment of the above description is alternatively prepared by substituting the single plasticizer incorporation with a binary mixture of different types of plasticizer, while all the other respective material composition/ingredient/concentration/layer thickness specifications are being kept exactly the same; (2) preparation of anticurl back coating-free imaging member of interest may also cover multitudes of charge transport layers of from about three to about six layers of same thickness (illustrations not included), by following the same procedures and material compositions to give exact same total layers thickness as detailed in all the preceding embodiments; and (3) to impact greater mechanical function enhancement for anticurl back coating-free imaging member having multitudes of charge transport layers, the bottom layer contains more amount of the charge transport compound than that in the outermost exposed top layer in a continuum descending order for achieving optimum photo-electrical performance, greatest wear resistance, as well cracking life extension. The charge transport compound presence in the outermost exposed top layer is between about 20 and about 40 weight percent while that in the bottom layer is between about 60 and about 80 weight percent based on the combined weight of charge transport compound and polymer binder 24 in each respective layer. For the reformulation design that the binder 24 used in all the charge transport layers is a binary polymer formed from polymer blending of the novel A-B diblock copolymer and a conventional bisphenol polycarbonate, the weight ratio of copolymer to polycarbonate in the polymer blended binder is between about 95:5 and about 5:95.

Lastly, in particularly extended modified embodiments, the A-B diblock copolymer of Formula (I) and (II) for use as charge transport binder 24 of plasticized charge transport layer(s) in all these anticurl back coating-free imaging member embodiments may be substituted by using their respective molecular modifications of the A-B diblock copolymer. The molecular structure variances of modifying the diblock copolymer can be achieved through the replacement of the bisphenol A segmental block (A) in the copolymer of Formulas (I) and (II) by substituting each of the following types of carbonates selected to consist of:

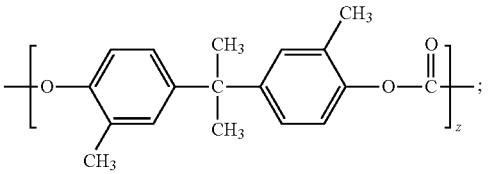

-continued

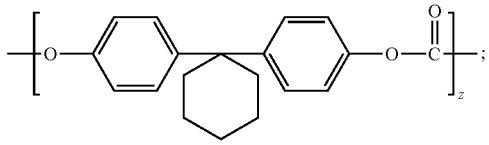

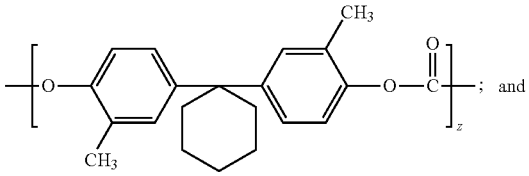

and

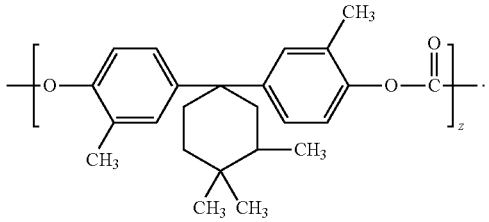

In another extended modified embodiment, the phthalic acid terminated segmental block (B) linkage in the A-B diblock copolymer molecule of both Formulas (I) and (II) may also be replaced by one of the selected groups consisting of:

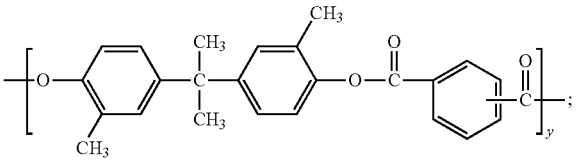

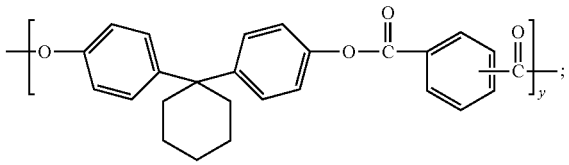

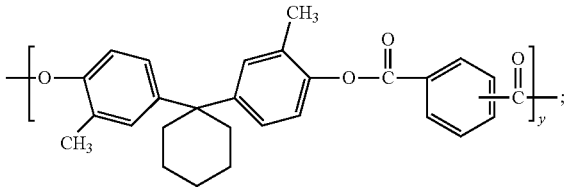

and

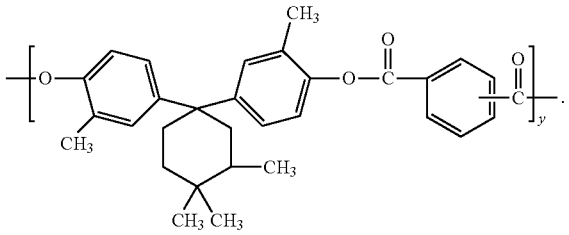

Additionally, the phthalic acid component in the segmental block (B) of the A-B diblock copolymer may also be replaced with a terephthalic acid, an isophthalic acid represented by the following, respectively:

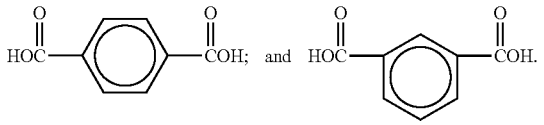

or alternatively, by an adipic acid or an azelaic acid shown below:

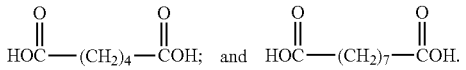

In yet another extended modified embodiment, both the segmental blocks (A) and (B) in the A-B diblock copolymer of Formulas (I) and (II), used as charge transport layer binder, are replaced by the segmental alternates selected from groups consisting of all the variances described above to give an extended set of A-B diblock copolymers having many modified molecular structures.

All the above flexible anticurl back coating-free imaging members of present disclosure, as prepared to contain an acid containing A-B diblock copolymer binder (or binary polymer binder of blending the diblock copolymer and a bisphenol polycarbonate) 24 in the plasticized charge transport layer(s), do, by comparison, exhibit effective improvement over the conventional anticurl back coating-free imaging member control counterpart in: curl control, mechanical property enhancement, lowing photo-induce discharge (PIDC) potential cycle-up, stable exposure/development voltage ($V_e$) for latent image formation, and amine species quenching/neutralization capability to eliminate the ghosting defects problem in the print out copy. Thus, the anticurl back coating-free imaging members as prepared according to the present disclosure have, for example, 10 k cyclic photoelectrical changes in charge acceptance ($V_0$) in a range of from about 750 to about 850 volts; sensitivity (S) sensitivity of from about 420 to about 360 volts/ergs/cm$^2$; net residual potential ($V_r$) cycle-up of less than about 5 volts; an a depletion potential ($V_{depl}$) increase of less than 10 volts; a photo induced dark decay (PIDC) characteristic of about 55% increase; and a stable development voltage ($V_e$) of from about 50 to about 65 volts at 2 ergs/cm$^2$ exposure measured by using a laboratory 4000 scanner under a constant current electrical charging test condition.

The resulting charge transport layer prepared according to the description of present disclosure (only the top exposed layer of the multiple layers) may also contain a light shock resisting or reducing agent of from about 1 to about 6 wt %. Such light shock resisting agents include 3,3',5,5'-tetra(t-butyl)-4,4'-diphenoquinone (DPQ); 5,6,11,12-tetraphenyl naphthacene (Rubrene); 2,2'-[cyclohexylidenebis[(2-methyl-4,1-phenylene)azo]]bis[4-cyclohexyl-(9Cl)]; perinones; perylenes; and dibromo anthanthrone (DBA). To further improve the mechanical performance of the present imaging members, the top charge transport layer, being a single layer or multiple layers, may also include the additive of inorganic or organic fillers to impart greater wear resistant enhancement. Inorganic fillers may include, but are not limited to, silica, metal oxides, metal carbonate, metal silicates, and the like. Examples of organic fillers include, but are not limited to, KEVLAR, stearates, fluorocarbon (PTFE) polymers such as POLYMIST and ZONYL, waxy polyethylene such as ACUMIST and ACRAWAX, fatty amides such as PETRAC erucamide, oleamide, and stearamide, and the like. Either micron-sized or nano-sized inorganic or organic particles can be used in the fillers to achieve mechanical property reinforcement. One suitable particulate dispersion is described in U.S. Pat. No. 6,326,111, which is hereby incorporated by reference in its entirety.

For typical conventional flexible ionographic imaging members preparation used in an electrographic system, they may be re-designed to eliminate the need of an anticurl back coating, by which the dielectric imaging layer overlying the conductive layer of a substrate may likewise be reformulated, to use the novel A-B diblock copolymer for protection against amine attack and also with the incorporation of plasticizer(s) to render internal tension stress/strain relief for effecting curl control, by the same manner according to the descriptions detailed in the present disclosure.

The flexible anticurl back coating-free multilayered electrophotographic imaging member fabricated in accordance with the embodiments of present disclosure, described in all the above preceding, may be cut into rectangular sheets. A pair of opposite ends of each imaging member cut sheet is then brought overlapped together thereof and joined by any suitable means, such as ultrasonic welding, gluing, taping, stapling, or pressure and heat fusing to form a continuous imaging member seamed belt, sleeve, or cylinder.

A prepared flexible anticurl coating free imaging belt thus may thereafter be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member. Thus, by applying a suitable electrical bias and selecting toner having the appropriate polarity of electrical charge, a toner image is formed in the charged areas or discharged areas on the imaging surface of the electrophotographic imaging member. For example, for positive development, charged toner particles are attracted to the oppositely charged electrostatic areas of the imaging surface and for reversal development, charged toner particles are attracted to the discharged areas of the imaging surface.

Furthermore, a prepared flexible curl free electrophotographic imaging member belt can additionally be evaluated by printing in a marking engine into which the belt, formed according to the exemplary embodiments, has been installed. For intrinsic electrical properties it can also be determined by conventional electrical drum scanners. Additionally, the assessment of its propensity of developing streak line defects print out in copies can alternatively be carried out by using electrical analyzing techniques, such as those disclosed in U.S. Pat. Nos. 5,703,487; 5,697,024; 6,008,653; 6,119,536; and 6,150,824, which are incorporated herein in their entireties by reference. All the patents and applications referred to herein are hereby specifically, and totally incorporated herein by reference in their entirety in the instant specification.

All the exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

EXAMPLES

The development of the presently disclosed embodiments will further be demonstrated in the non-limiting working examples below. They are, therefore in all respects, to be considered as illustrative and not restrictive nor limited to the materials, conditions, process parameters, and the like recited herein. The scope of embodiments are being indicated by the appended claims rather than the foregoing description. All changes that come within the meaning of and range of equivalency of the claims are intended to be embraced therein. All proportions are by weight unless otherwise indicated. It will be apparent, however, that the present embodiments can be practiced with many types of compositions and can have many different uses in accordance with the disclosure above and as pointed out hereinafter.

Prior Art Example

A conventional prior art flexible electrophotographic imaging member web, as shown in FIG. 1, prepared by hand coating process, was provided a 0.02 micrometer thick titanium layer 12 coated substrate of a biaxially oriented polyethylene naphthalate substrate 10 (PEN, available as KADALEX from DuPont Teijin Films.) having a thickness of 3.5 mils. The titanized KADALEX substrate was extrusion coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and effect the formation of a crosslinked silane blocking layer. The resulting blocking layer 14 had an average dry thickness of 0.04 micrometer as measured with an ellipsometer.

An adhesive interface layer 16 was then applied by extrusion coating to the blocking layer with a coating solution containing 0.16 percent by weight of ARDEL polyarylate, having a weight average molecular weight of about 54,000, available from Toyota Hsushu, Inc., based on the total weight of the solution in an 8:1:1 weight ratio of tetrahydrofuran/monochloro-benzene/methylene chloride solvent mixture. The adhesive interface layer was allowed to dry for 1 minute at 125° C. in a forced air oven. The resulting adhesive interface layer 16 had a dry thickness of about 0.02 micrometer.

The adhesive interface layer was thereafter coated over with a charge generating layer 18. The charge generating layer dispersion was prepared by adding 0.45 gram of IUPILON 200, a polycarbonate of poly(4,4'-diphenyl)-1,1'-cyclohexane carbonate (PCZ 200, available from Mitsubishi Gas Chemical Corporation), and 50 milliliters of tetrahydrofuran into a 4 ounce glass bottle. 2.4 grams of hydroxygallium phthalocyanine Type V and 300 grams of ⅛ inch (3.2 millimeters) diameter stainless steel shot were added to the solution. This mixture was then placed on a ball mill for about 20 to about 24 hours. Subsequently, 2.25 grams of poly(4,4'-diphenyl-1,1'-cyclohexane carbonate) having a weight average molecular weight of 20,000 (PC-Z 200) were dissolved in 46.1 grams of tetrahydrofuran, then added to the hydroxygallium phthalocyanine slurry. This slurry was then placed on a shaker for 10 minutes. The resulting slurry was thereafter coated onto the adhesive interface by extrusion application process to form a layer having a wet thickness of 0.25 mil. However, a strip of about 10 millimeters wide along one edge of the substrate web stock bearing the blocking layer and the adhesive layer was deliberately left uncoated by the charge generating layer (CGL) to facilitate adequate electrical contact by a ground strip layer 19 to be applied later. This CGL comprised of poly(4,4'-diphenyl)-1,1'-cyclohexane carbonate, tetrahydrofuran and hydroxygallium phthalocyanine was dried at 125° C. for 2 minutes in a forced air oven to form a dry CGL 18 having a thickness of 0.7 micrometers.

This coated web was simultaneously coated over with a charge transport layer (CTL) 20 and a ground strip layer 19 by co-extrusion of the coating materials. The CTL 20 was prepared by introducing into an amber glass bottle in a weight ratio of 1:1 (or 50 weight percent of each) of a bisphenol A polycarbonate thermoplastic (FPC 0170, having a molecular weight of about 120,000 and commercially available from Mitsubishi Chemicals Corp.) and a diamine charge transport compound of N,N'-diphenyl-N,N'-bis(3-methylphenyl)-1,1'-biphenyl-4,4'-diamine.

The FPC 0170 bisphenol A polycarbonate used as CTL 20 binder is a poly(4,4'-isopropylidene diphenyl carbonate) of Formula (A) shown below:

Formula (A)

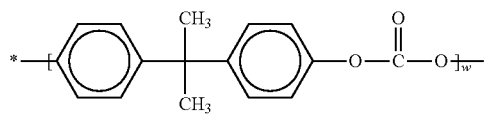

wherein w is the degree of polymerization.

The resulting mixture was dissolved to give 15 percent by weight solid in methylene chloride. This solution was applied on the CGL 18 by extrusion process to form a coating which after drying in a forced air oven gave a 29 micrometers thick dry CTL 20 comprising 50:50 weight ratio of diamine transport charge transport compound to FPC0170 bisphenol A polycarbonate binder. The imaging member web, at this point if unrestrained, would curl upwardly into a 1¾-inch tube.

The strip, about 10 millimeters wide, of the adhesive layer left uncoated by the CGL, was coated with a ground strip layer during the co-extrusion process. The ground strip layer coating mixture was prepared by combining 23.81 grams of polycarbonate resin (FPC 0170, available from Mitsubishi Chemical Corp.) having 7.87 percent by total weight solids and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose and 87.7 parts by weight of solvent (ACHESON Graphite dispersion RW22790, available from Acheson Colloids Company (Port Huron, Mich.)) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the CTL, to the electrophotographic imaging member web to form an electrically conductive ground strip layer.

The imaging member web stock containing all of the above layers was then placed in a 125° C. forced air oven to dry the co-extrusion coated ground strip 16 and CTL 20 simultaneously to give respective 19 micrometers and 29 micrometers in dried thicknesses after eventual cooling down to room ambient. The resulting imaging member web had a 29 micrometer-thick single layered CTL 20, according to the conventional art shown in FIG. 1, but without application of an anticurl back coating was seen, if unrestrained as it cooled down to room ambient of 25° C., to spontaneously curl upwardly into a 1½ inch roll. The prepared imaging member web was to be used to serve as a control.

An anticurl back coating was prepared by combining 882 grams of FPC 0170 bisphenol A polycarbonate resin of Formula (A), 71.2 grams VITEL PE-200 copolyester (available from Goodyear Tire and Rubber Company) and 10,710 grams of methylene chloride in a carboy container to form a coating solution containing 8.9 percent solids. The container was covered tightly and placed on a roll mill for about 24 hours until the polycarbonate and polyester were dissolved in the methylene chloride to form the anti-curl back coating solution. The anticurl back coating solution was then applied to the rear surface (side opposite the CGL and charge CTL) of the electrophotographic imaging member web by extrusion coating and dried to a maximum temperature of 125° C. through the forced air oven to produce a dried 17 micrometer thick anticurl back coating 1 and render the imaging member web with desirable flatness

Reference Example

Another flexible electrophotographic imaging member web was prepared by using the same material compositions and following identical procedures to give all the layers as those described in the above Prior Art Example shown in FIG. 1, but with the exception that FPC 0170 bisphenol A polycarbonate of Formula (A) binder in the CTL 20 of the imaging member web was totally replaced with a novel film forming A-B diblock copolymer. The A-B diblock copolymer (LEXAN HLX polycarbonate, available from Sabic Innovative Plastics) is consisting of 90 mole percent of bisphenol A polycarbonate segment block A which is linking to 10 mole percent of phthalic acid containing segment block B. LEXAN HLX polycarbonate as received has a molecular weight of about 115,000 and is a mixture of the two general molecular structures shown in Formulas (I) and (II) below:

wherein z representing the numbers of bisphenol A repeating units of block A has a value of 9; y representing the numbers of repeating phthalic acid unit of block B has a value of 1; and n is the degree of polymerization of the A-B diblock copolymer having a molecular weight of about 115,000, as available from Sabic Innovative Plastics.

Photoelectrical Measurements

The photoelectrical properties of the imaging member webs of both the Prior Art and the Reference Examples were determined by using the 4000 laboratory scanner under a constant current electrical Charging test condition. The measurement results thus obtained (shown in Table 1 below) indicate that the imaging member of Reference Example, prepared to employ a phthalic acid terminated A-B diblock copolymer binder in CTL 20, did not cause any adverse impact to the photoelectrical integrity of the resulting imaging member as compared to the conventional prior art imaging member with a CTL 20 using bisphenol A polycarbonate. These results thereby indicate that imaging member of Reference Example, having the CTL reformulated through the use of the phthalic acid containing A-B diblock copolymer binder for total FPC 0170 bisphenol A polycarbonate replacement, should be a reasonable, convenient, and valid CTL redesign acceptable for imaging member production implementation.

TABLE 1

| Sample ID | CTL Binder | Vo | S | Vc | Vr | $V_{e-6.0}$ | Vdepl | Vdd |
|---|---|---|---|---|---|---|---|---|
| Prior Art | Polycarbonate | 799 | 351 | 160 | 26.5 | 44.9 | 56.2 | 34.5 |
| Reference | Copolymer | 799 | 334 | 165 | 26.9 | 47.9 | 53.9 | 35.4 |
| | | After 10K cycles | | | | | | |
| Prior Art | Polycarbonate | 799 | 333 | 194 | 45.9 | 74.4 | 104.8 | −54.3 |
| Reference | Copolymer | 799 | 326 | 182 | 33 | 59.5 | 105.1 | −37.4 |

It is important to note that the use of A-B diblock copolymer as CTL binder 24, having a molecular weight of about 115,000, should also assure that the mechanical function integrity of the redesigned CTL layer would be maintained to at least equivalent to the CTL 20 formulated to contain the conventional bisphenol A polycarbonate of Formula (A) in the prior art imaging member.

Formula (I)

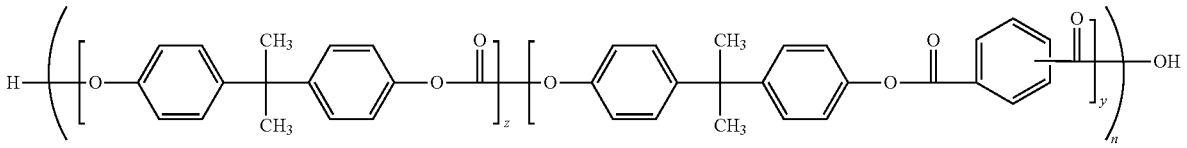

Block (A) Block (B)

Formula (II)

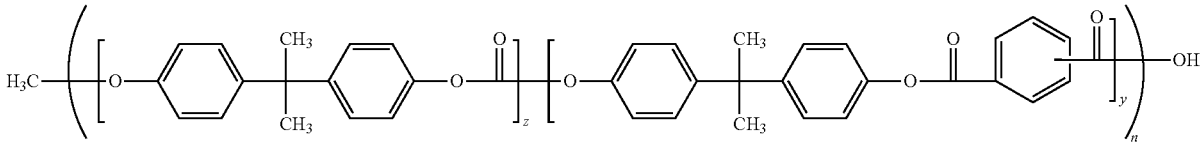

Block (A) Block (B)

Control Example

Three flexible anticurl back coating-free electrophotographic imaging member webs were prepared with the exact same material compositions and following identical procedures according to those in imaging member of FIG. 1 described in the Prior Art Example, but with the exception that the anticurl back coating 1 was excluded and the single CTL 20 (comprising 50:50 weight ratio of diamine transport charge transport compound to bisphenol A polycarbonate of Formula (A) binder 24) of these imaging member webs was each plasticized by the incorporation of 4, 6, and 8 weight percent, respectively, of liquid diethyl phthalate (DEP, available from Sigma-Aldrich Corporation), based on the total weight of the resulting plasticized CTL 20, to give imaging member webs shown in FIG. 2. The molecular structure of liquid DEP plasticizer 26 used is shown in below formula:

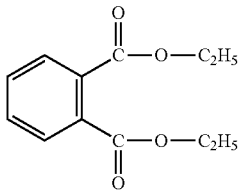

Disclosure Example

Three flexible anticurl back coating-free electrophotographic imaging member webs were repeatedly prepared with the exact same material compositions and following identical procedures according to those in imaging member of FIG. 2 described in the above Control Example, but with the exception that the bisphenol A polycarbonate of Formula (A) binder 24 in CTL 20 was substituted by the novel LEXAN HLX A-B diblock copolymer having the general molecular structures shown in Formulas (I) and (II) below:

Curl and Photo-Electrical Evaluation

All the three flexible anticurl back coating-free electrophotographic imaging member webs prepared to contain plasticized LEXAN HLX A-B diblock copolymer CTL binder of Disclosure Example I were assessed for degree of imaging member curling and photoelectrical property impact respectively against their corresponding three flexible anticurl back coating-free electrophotographic imaging member webs prepared to have plasticized bisphenol A polycarbonate binder CTL of the Control Example. The results obtained, listed in Table 2 below, show that incorporation of plasticizer DEP into the Disclosure Example I imaging member CTL 20, reformulated using diblock copolymer binder, gave better imaging member curl suppression outcome than the Control Example imaging member counterparts having same respective DEP level of plasticizer in CTL 20 but using the conventional bisphenol A polycarbonate binder. The data in the table do also indicate that, for example by interpolation, a 7 weight percent DEP plasticized CTL prepared according to Disclosure Example I description could produce a flattening result of about equivalent to that of an 8 weight percent DEP loaded CTL imaging member of the Control Example.

TABLE 2

| CTL IDENTIFICATION | % wt DEP | DIAMETER OF CURVATURE |
|---|---|---|
| Disclosure/Control | 4 | 5.7/4.5 inches |
| Disclosure/Control | 6 | 15.2/12.5 inches |
| Disclosure/Control | 8 | 19.4/15.8 inches |

The three anti curl free imaging members, having 4, 6, and 8 weight percent respective DEP plasticized CTL of Disclosure Example I and the 8 weight percent DEP plasticized CTL of Control Example were further evaluated for photoelectrical properties using the 4000 lab. scanner under a constant current electrical Charging test condition. The testing result obtained, shown in Table 3, have assured that the disclosed CTL plasticized with three experimental DEP loading levels, did not cause deleterious photo-electrical performance Formula (I)

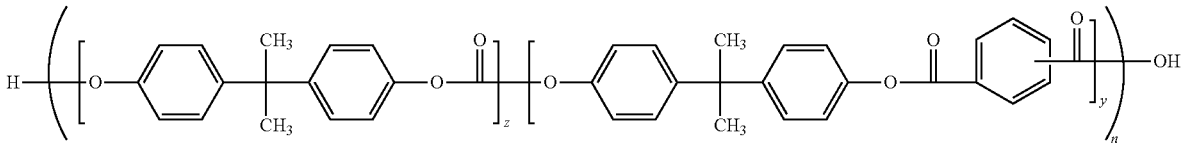

Block (A) Block (B)

Formula (II)

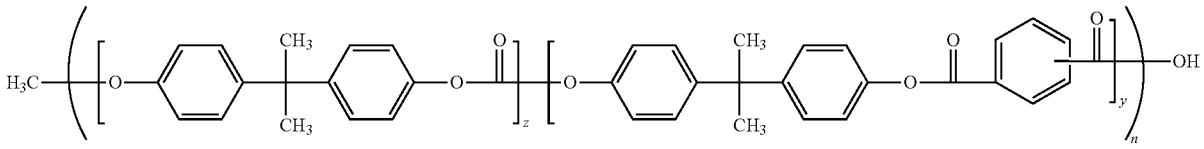

Block (A) Block (B)

The reformulated CTL in each of these imaging member webs, shown in FIG. 2, did contain 4, 6, and 8 weight percent of liquid DEP 26 incorporation, based on the total weight of each respective plasticized CTL 20.

impact. In fact, at same DEP loading level of 8 weight percent in the CTL, the imaging member of this disclosure was seen to have only about 47% increase in development potential ($V_e$) cycle-up at 2 ergs/cm$^2$ exposure relative to the $V_e$ value obtained for the Control Example imaging member. Therefore, in addition to the amine quenching/neutralization capability of the diblock copolymer, the observed $V_e$ stability (based on the scanner data) does suggest that imaging member utilizing the A-B diblock copolymer binder in the plasticized CTL would further provide an additional benefit of being able to effectively suppress ghosting defect appearing in the copy printouts, even at higher loading level needed for achieving absolute imaging member curl free control.

TABLE 3

| MEMBER ID | % wt DEP | $V_o$ | S | $V_r$ | $V_{dept}$ | $V_e$ |
|---|---|---|---|---|---|---|
| STD CTL Control | 8 | 800 | 397.6 | 43 | 24 | 90 |
| Copolymer CTL | 4 | 800 | 404.6 | 42 | 31 | 90 |
| Copolymer CTL | 6 | 800 | 353.2 | 30 | 25 | 90 |
| Copolymer CTL | 8 | 800 | 397.6 | 40 | 32 | 91 |
| After 10K Cycles | | | | | | |
| STD CTL Control | 8 | 800 | 354.6 | 80 | 68 | 155 |
| Copolymer CTL | 4 | 800 | 360.5 | 47 | 29 | 122 |
| Copolymer CTL | 6 | 800 | 348.4 | 38 | 24 | 120 |
| Copolymer CTL | 8 | 800 | 351.3 | 46 | 33 | 124 |

Therefore, based on the results obtained from curl analysis and the scanner constant current charging photoelectrical test measurements for all the anticurl free imaging member prepared as described in the present disclosure examples and compared against the control, it is evident that plasticizing a CTL reformulated with utilization of the novel A-B diblock copolymer binder (1) provides greater imaging member flattening control result than the plasticized control CTL counterpart having a conventional bisphenol A polycarbonate binder, so to facilitate the use of lower plasticizer loading in CTL could provide the benefit of eliminating the ghosting defect appearance in copy printout issue associated to the consequence of electrical $V_e$ cycle-up problem seen in the plasticized CTL employing the conventional bisphenol A polycarbonate binder; (2) allow higher plasticizer incorporation into the CTL of this disclosure, if needed, for achieving absolute imaging member flatness without introducing unwanted photoelectrical cyclic problem to meet each respective upstream copier machines development requirement; and (3) impact dominant $V_e$ cyclic behavior of the imaging member than the loading level of a plasticizer in the CTL to allow $V_e$ stability tuning effect, by binary polymer blending with the conventional bisphenol A polycarbonate, for achieving optimum photoelectrical function result.

Production Belt Disclosure Example

Production quality web stocks of anticurl back coating-free imaging members having plasticized CTL, utilizing (a) the A-B diblock copolymer binder in one section of the web stock and (b) the conventional biphenol A polycarbonate binder control in two subsequent sections of the web stock, were prepared. The CTL containing the diblock copolymer was plasticized with 8 weight percent DEP plasticizer while the control CTL(s) of the two subsequent sections were respectively formed to include 8, and 14 weight percent DEP loading levels, based on the total weight of each resulting CTL. Photoelectrical property assessment for these web stock sections was then carried out as follows:

Laboratory Scanner Test

Figure 5:
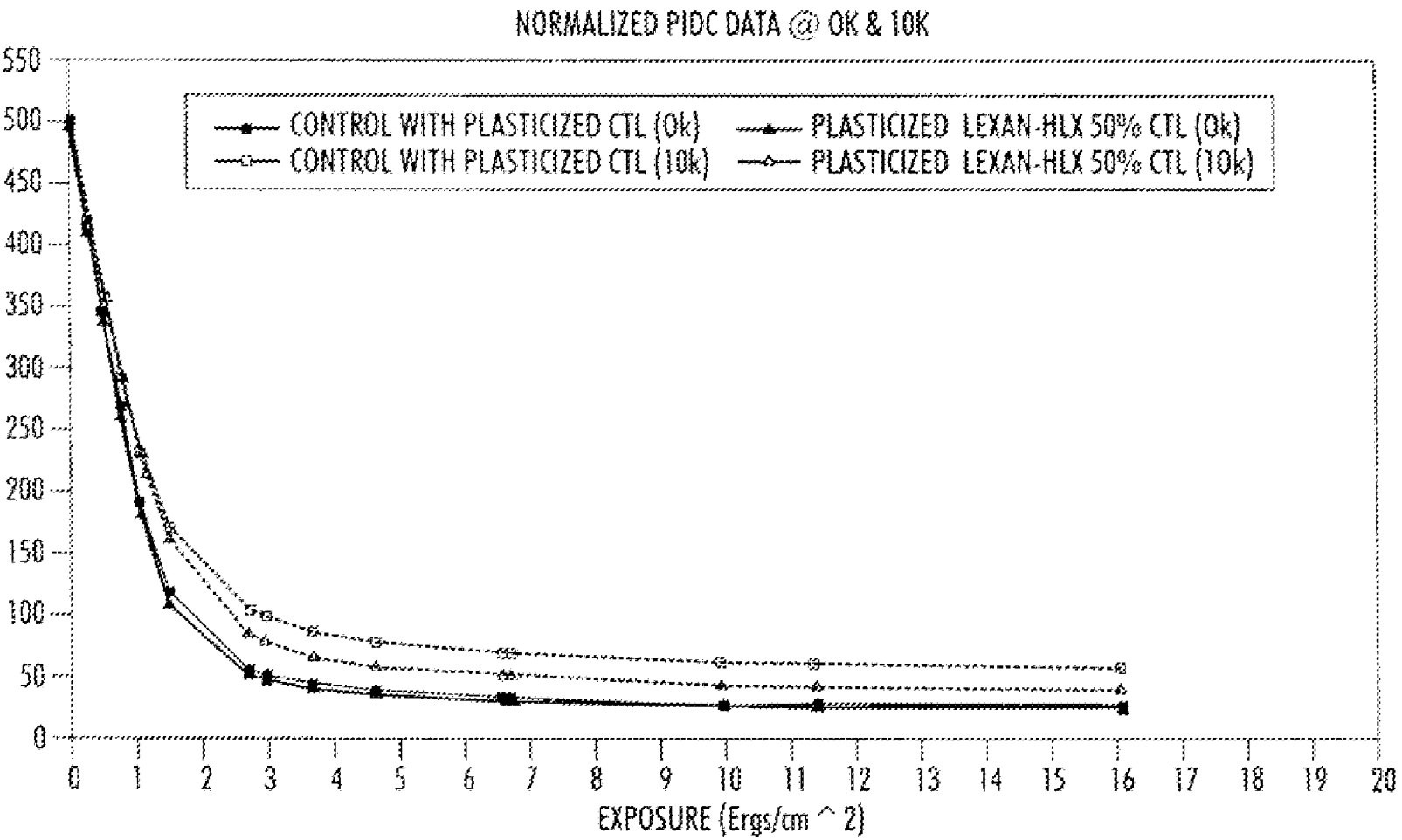
FIG. 5 shows the comparison of photo induced discharge characteristic curves (PIDC) from 0 to 10 K electrical cycles between the flexible anticurl back coating-free multilayered electrophotographic imaging members prepared according to the present disclosure and a control flexible anticurl back coating-free imaging member counterpart in reference to the disclosed prior art imaging member.

Laboratory scanner photoelectrical test, under constant current electrical Charging condition, was conducted only for pieces of cut samples from the 8 weight percent DEP plasticized CTL of the two imaging member designs for up to 10 K cycles to allow direct comparison. The results obtained for both imaging members, containing the exact same 8 weight percent DEP loading level in the CTL, are presented in normalized photo induced dark decay characteristic (PIDC) curves shown in FIG. 5. As illustrated in the figure, the PIDC of the redesigned plasticized CTL, prepared by utilizing the A-B diblock copolymer binder of present disclosure, has established that it does have a more stable photoelectrical function to give less extent of $V_e$ cycle-up than that of the imaging member control counterpart having a plasticized CTL formulated to consist of conventional bisphenol A polycarbonate binder after 10 K photoelectrical cycling test. Furthermore, the imaging member having the disclosed CTL is also seen to show an added advantage of having better curl control to give a flatter imaging member compared to the control at same 8 weight percent level of DEP incorporation.

Text Fixture Electrical Belt Cycling Test

Figure 6:
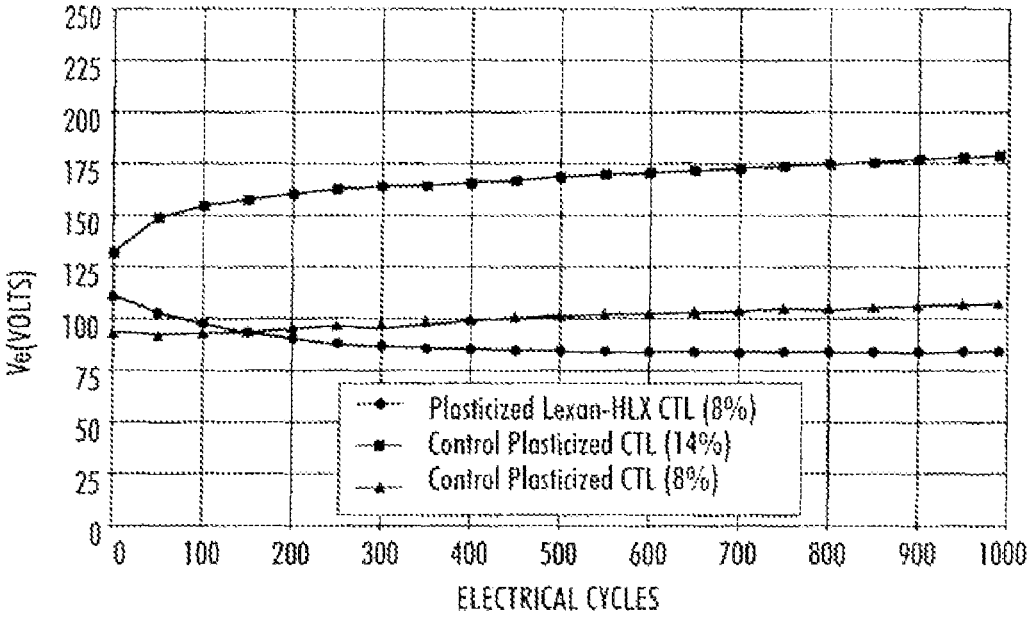
FIG. 6 shows plots of development potentials ($V_e$) and the flexible anticurl back coating-free multilayered electrophotographic imaging members prepared according to the present disclosure compared to those of two control flexible anticurl back coating-free imaging member counterparts in reference to the disclosed prior art imaging member.

All the anticurl free imaging member web stocks were further cut into 1,486 mm×380 mm rectangular sheets; the opposite ends of each cut sheet were looped and then ultrasonically welded into two flexible imaging member seamed belts. All the three prepared anticurl back coating-free imaging member belts, having 8 and 14 weight percents DEP plasticized CTL(s) described above, were then electrically cycling tested, using a TEXT fixture under constant charge voltage condition up to 5,000 dynamic electrical cycles, for direct photoelectrical response assessment and comparison. The testing results thus obtained, shown in FIG. 6, had indicated that the development potential ($V_e$) cycle-up at 2 ergs/$cm^2$ exposure for the conventional CTL was highly exacerbated by the loading level of plasticizer in the CTL and was seen to reach the worst and became unacceptable at 14 weight percent loading level for practical electrophotographic belt function. Although lowering to 8 weight percent level to soften the $V_e$ cycle-up was determined to be adequate for imaging member implementation, but the steady $V_e$ increase with belt cycling has limited the belt value for long term service function. By contrary, the imaging member belt having the disclosed CTL, comprised of -B diblock copolymer binder and 8 weight percent DEP, was found (though exhibiting initial cycle-down) to provide a stable electrical $V_e$ cyclic stability improvement over the control imaging member belt counterpart to potential impact ultimate belt life extension.

In addition to the photoelectrical improvement, the plasticized CTL utilizing the A-B diblock copolymer binder was found to have good layer adhesion value greater than that of the adhesion specification; this would therefore ensure that the CTL layer's bonding strength and integrity without the possibility of developing layer delamination problem during imaging member belt dynamic fatigue machine function in the field.

Nuvera Machine Print Test

The imaging member belts machine print testing was further carried out, only for the two 8 weight percent DEP plasticized CTL(s), with the use of a Nuvera copier under constant charge voltage condition, up to 500,000 print volumes. The results thus obtained from Nuvera machine belt cycling test are plotted as delta $V_e$ vs. numbers of machine cycles and presented in FIG. 7. In summary, the overall testing results collected from lab. scanner, Tex Fixture, and Nuvera machine belt cyclic-print test are complementary to each other and give corroborative support/confirmation to definitively indicate that anticurl back coating-free imaging members, with plasticized CTL prepared to contain the A-B diblock copolymer binder or a binary polymer binder comprising a blend of the copolymer and a bisphenol polycarbonate according to present disclosure composition, did provide significant photoelectrical function improvement to give a stable $V_e$ cycle-up control, by comparison, over that seen for the imaging member control counterpart having plasticized CTL that comprised only a conventional bisphenol A polycarbonate binder.

Figure 7:
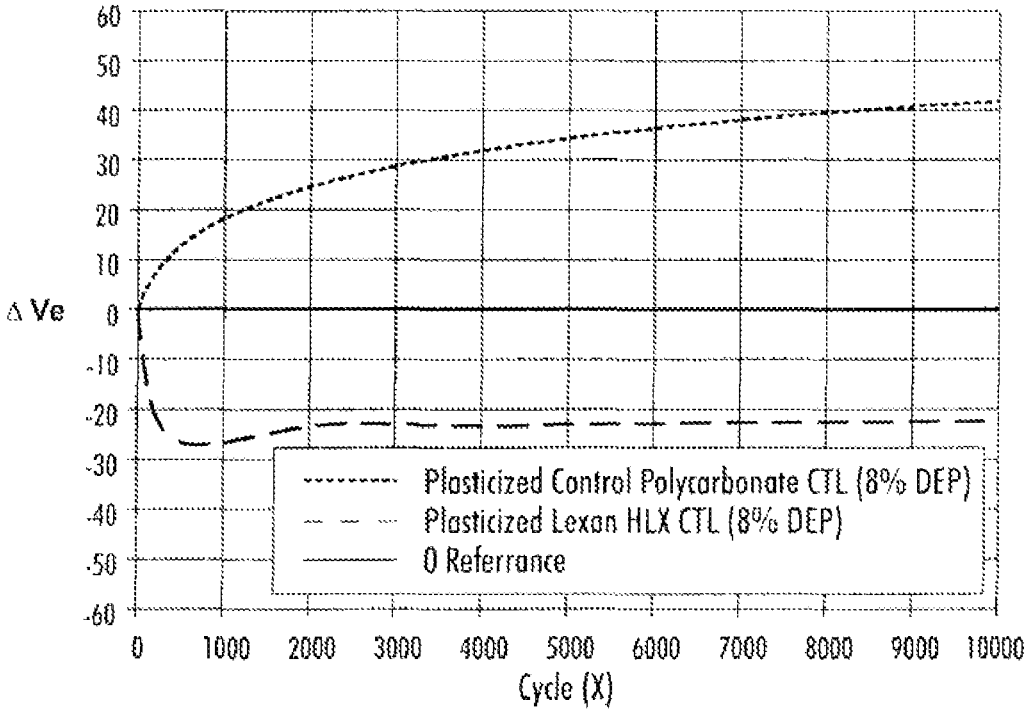
FIG. 7 shows delta $V_e$ (rate of $V_e$ change per cycle) vs machine cyclic belt function between the flexible anticurl back coating-free multilayered electrophotographic imaging members prepared according to the present disclosure a control flexible anticurl back coating-free imaging member counterpart in reference to the disclosed prior art imaging member.

However, it is important to note that the plots given in FIG. 7 provide a stable $V_e$ function region indicating that a photoelectrically tunable and curl-free imaging member could be created and tailored through modification of the plasticized CTL design to effect function inside the envelop bounded by the two curves. This is achieved by utilizing polymer blending approach to form binary polymer blended binder comprised of mixing the A-B diblock copolymer (LEXAN HLX) and a bisphenol A polycarbonate, poly(4,4'-isopropylidene diphenyl carbonate) of Formula (A) below:

Formula (A)

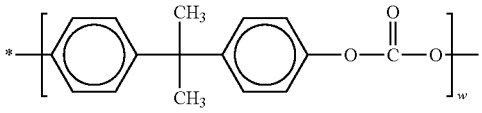

wherein w indicates the degree of polymerization or alternatively, mixing with a bisphenol Z polycarbonate of poly(4,4'-diphenyl-1,1'-cyclohexane carbonate) given in Formula (B):

Formula (B)

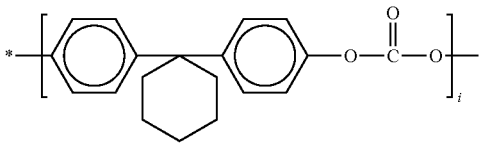

wherein i indicates the degree of polymerization and each these polycarbonates is preferred to have a molecular weight of between about 100,000 and 150,000 for solvent solubility need and robust mechanical function consideration.

The weight ratios of A-B diblock copolymer to a polycarbonate in the created binary polymer blended binder is between about 95:5 and about 5:95. To render optimum result, the weight ratio in the polymer blended binder, for a given plasticizing level, could be adjusted by experimental tuning to inside the domain bound by the control and disclosure imaging members curves; in such a manner, the imaging member accordingly prepared should give absolutely electrically stable Ve cyclic function to reach the ideal and zero delta $V_e$ reference line shown in FIG. 7. Therefore by which, fabrication of an ultimate curl-free imaging member belt design having infinite electrical cyclic functioning life can be achieved.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

All the patents and applications referred to herein are hereby specifically, and totally incorporated herein by reference in their entirety in the instant specification.

The invention claimed is:

1. An imaging member comprising:

a flexible substrate;

a charge generating layer disposed on the substrate; and at least one charge transport layer disposed on the charge generating layer, wherein the charge transport layer comprises at least one liquid plasticizing compound in a solid solution further comprising a diamine charge transport component, and a polycarbonate binder, wherein the polycarbonate binder is an A-B diblock copolymer comprising two segmental blocks of a bisphenol A carbonate ($C_{16}H_{14}O_3$) block (A) and a phthalic acid containing terminal block (B) capable of providing protection against amine species contaminants, and further wherein the imaging member does not include an anticurl back coating layer.

2. The imaging member of claim 1, wherein the charge transport component is N,N'-diphenyl-N,N'-bis(3-methylphenyl)-1,1-biphenyl-4,4'-diamine.

3. The imaging member of claim 1, wherein the charge transport component is present in the charge transport layer in an amount of from about 10 to about 90 weight percent based on the combined weight of the charge transport component and the polycarbonate binder in the charge transport layer.

4. The imaging member of claim 1, wherein the polycarbonate binder is present in the charge transport layer in an amount of from about 90 to about 10 weight percent based on the combined weight of the charge transport component and the polycarbonate binder in the charge transport layer.

5. The imaging member of claim 1, wherein the plasticizing compound is present in the charge transport layer in an amount of from about 3 to about 15 weight percent based on the total weight of the charge transport layer.

6. The imaging member of claim 1, wherein the phthalic acid in the segmental block (B) of the A-B diblock copolymer binder is selected from the group consisting of terephthalic acid, isophthalic acid, adipic acid, azelaic acid, and mixtures thereof.

7. The imaging member of claim 6, wherein the phthalic acid containing terminal segmental block (B) linkage in the A-B diblock copolymer is replaced by one of the selected groups consisting of:

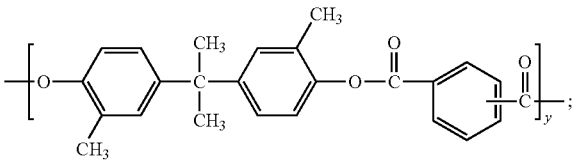

-continued

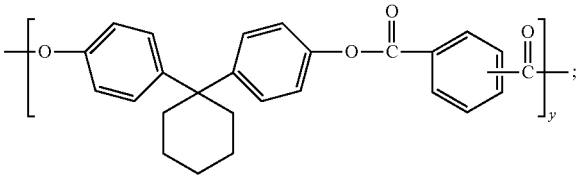

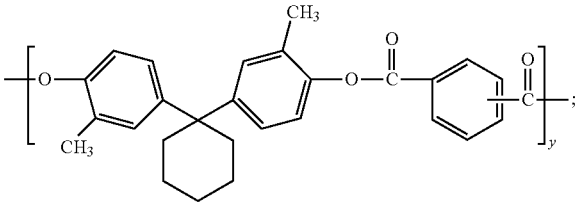

and

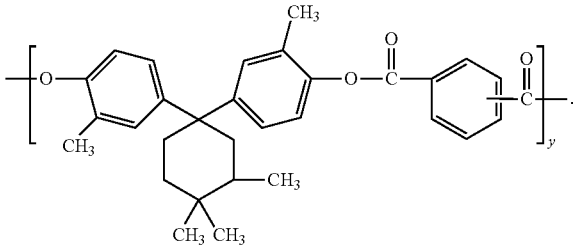

8. The imaging member of claim 7, wherein the phthalic acid component in the terminal segmental block (B) of the A-B diblock copolymer is substituted by a terephthalic acid or an isophthalic acid represented by the following:

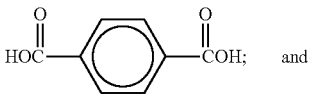

and

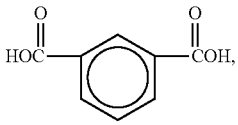

respectively or by an adipic acid or an azelaic acid represented by the following:

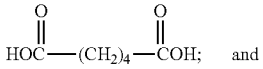

and

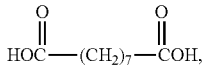

respectively.

9. The imaging member of claim 1, wherein the bisphenol A carbonate segmental block (A) of the A-B diblock copolymer is replaced by a carbonate selected from the group consisting of:

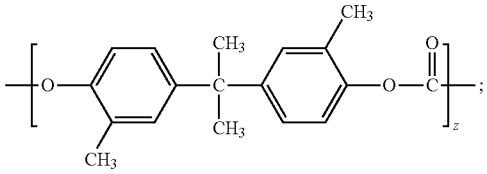

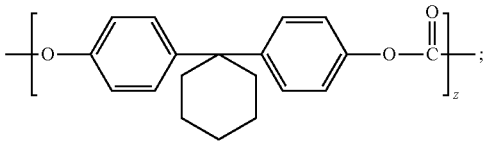

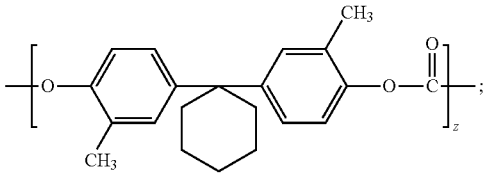

and

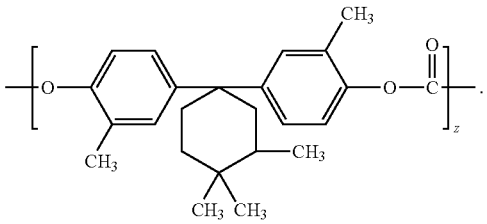

10. The imaging member of claim 1, wherein the A-B diblock copolymer binder in the at least one charge transport layer has a formula selected from the group consisting of the following molecular structures:

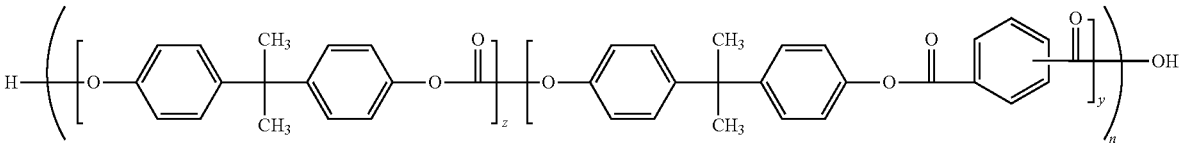

Block (A) Block (B)

wherein z representing the number of bisphenol A repeating units in block (A) is from about 9 to about 18, y representing the number of repeating phthalic acid in block (B) is from about 1 to about 2, and n representing the degree of polymerization of diblock copolymer is from about 20 to about 80; and

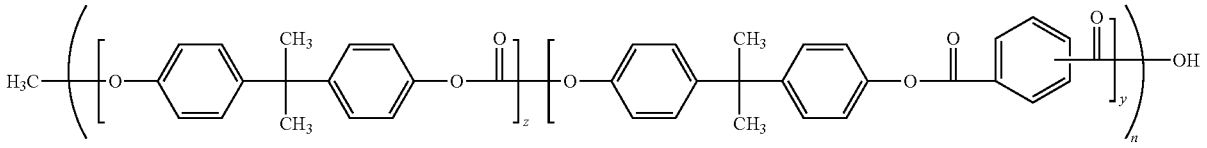

Block (A) Block (B)

wherein z representing the number of bisphenol A repeating units in block (A) is from about 9 to about 18, y representing the number of repeating phthalic acid in block (B) is from about 1 to about 2, and n representing the degree of polymerization of diblock copolymer is from about 20 to about 80, and mixtures thereof.

11. The imaging member of claim 1, wherein the A-B diblock copolymer binder has a molecular weight of from about 100,000 to about 200,000.

12. The imaging member of claim 1, wherein the thickness of the at least one charge transport layer is from about 20 micrometers to about 40 micrometers.

13. The imaging member of claim 1, wherein the liquid plasticizing compound is selected from the group consisting of:

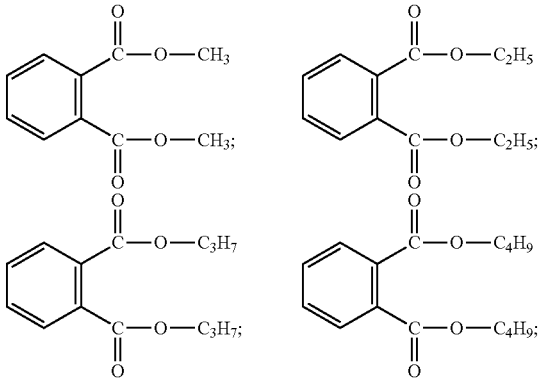

and

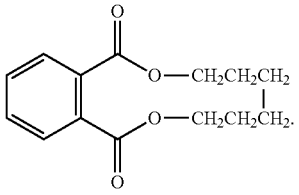

14. The imaging member of claim 13, wherein the liquid plasticizing compound has a boiling point of at least 250° C.

15. The imaging member of claim 1, wherein the liquid plasticizing compound is selected from the group consisting of plasticizing liquid of a phthalate, a phthalate derivative, a diallyl terephthalate, a modified diallyl terephthalate, a diallyl isophthalate, a modified diallyl isophthalate, a liquid carbonate, a styrene derivative, a dibasic alkyl ester, and a fluoroketone.

16. The imaging member of claim 1, wherein the polycarbonate binder is a polymer blend of the A-B diblock copolymer and a bisphenol polycarbonate selected from the group consisting of Formula (A)

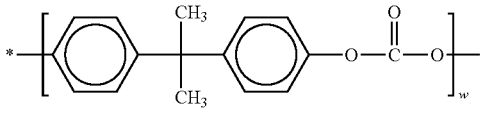

wherein w indicates the degree of polymerization;

Formula (B)

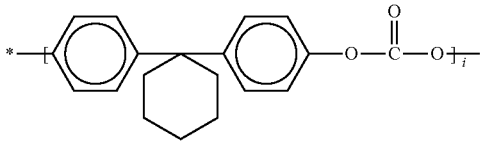

wherein i indicates the degree of polymerization;

Formula (C)

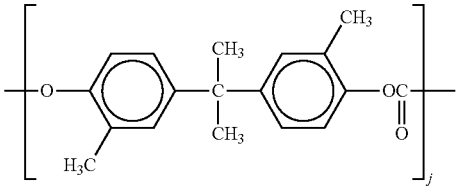

wherein j indicates the degree of polymerization; and

Formula (D)

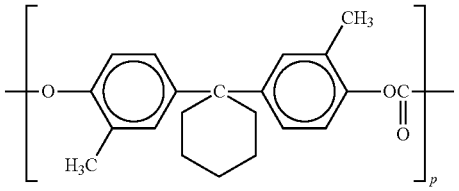

wherein p is the degree of polymerization.

17. The imaging member of claim 16, wherein the molecular weight of the bisphenol polycarbonate is between about 60,000 and about 200,000.

18. The imaging member of claim 16, wherein a weight ratio of the A-B diblock copolymer to the bisphenol polycarbonate is between about 5:95 and about 95:5.

19. An imaging member comprising:

a flexible substrate;

a charge generating layer disposed on the substrate; and a dual-layer charge transport layer including a bottom charge transport layer disposed on the charge generating layer and a top exposed charge transport layer disposed on the bottom charge transport layer, wherein each layer of the dual-layer charge transport layer comprises at least one liquid plasticizing compound present in the same weight percent in a solid solution further comprising a diamine charge transport component, and a polycarbonate binder, wherein the polycarbonate binder is an A-B diblock copolymer comprising two segmental blocks of a bisphenol A polycarbonate ($C_{16}H_{14}O_3$) and a phthalic acid, and further wherein the imaging member does not include an anticurl back coating layer.

20. The imaging member of claim 19, wherein both the bottom and the top exposed charge transport layers comprise the same diamine charge transport component, diblock copolymer binder and liquid plasticizing compound present in the same weight percent in solid solution based on the total weight of each respective charge transport layer.

21. The imaging member of claim 20, wherein the loading level of the same liquid plasticizing compound in each layer of the dual-layer charge transport layer is an amount of from about 3 to about 15 weight percent based on the total weight of each respective layer.

22. The imaging member of claim 19, wherein the polycarbonate binder in the top exposed charge transport layer is the A-B diblock copolymer while the polycarbonate binder in the bottom charge transport layer is a bisphenol polycarbonate selected from the group consisting of Formula (A)

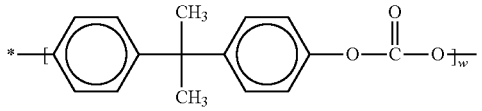

wherein w indicates the degree of polymerization;

Formula (B)

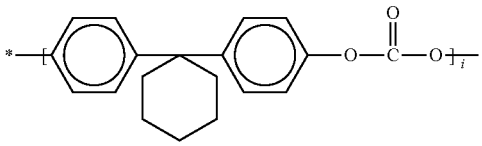

wherein i indicates the degree of polymerization;

Formula (C)

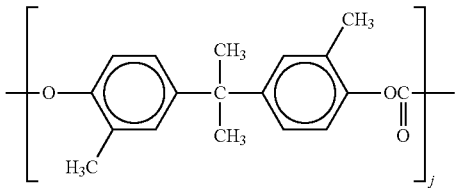

wherein j indicates the degree of polymerization; and

Formula (D)

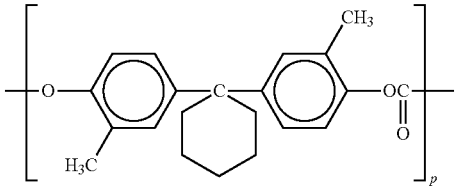

wherein p is the degree of polymerization.

23. The imaging member of claim 19, wherein the polycarbonate binder in the top exposed charge transport layer is a polymer blend of the A-B diblock copolymer and a bisphenol polycarbonate selected from the group consisting of Formula (A)

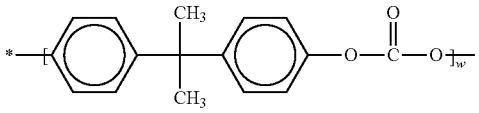

wherein w indicates the degree of polymerization;

Formula (B)

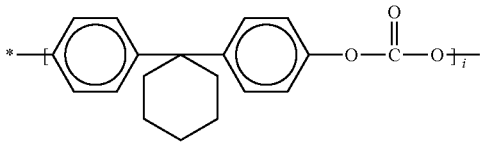

wherein i indicates the degree of polymerization;

Formula (C)

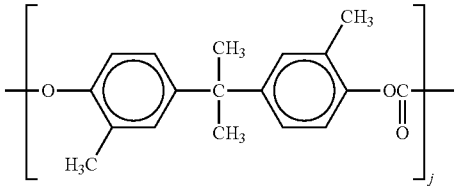

wherein j indicates the degree of polymerization; and

Formula (D)

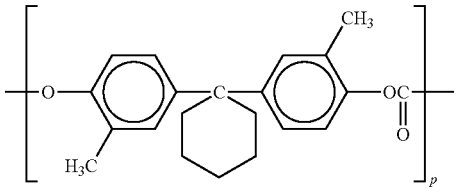

wherein p is the degree of polymerization, and the polycarbonate binder in the bottom charge transport layer is a bisphenol polycarbonate selected from the group consisting of Formula (A)

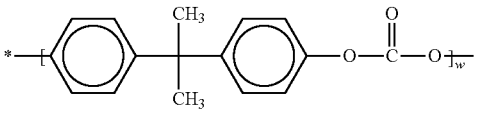

wherein w indicates the degree of polymerization;

Formula (B)

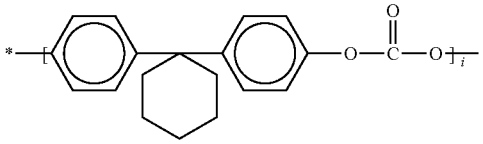

wherein i indicates the degree of polymerization;

Formula (C)

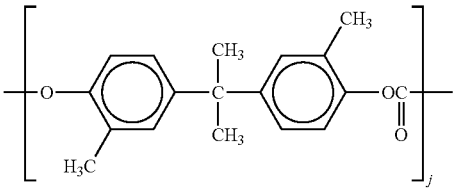

wherein j indicates the degree of polymerization; and

Formula (D)

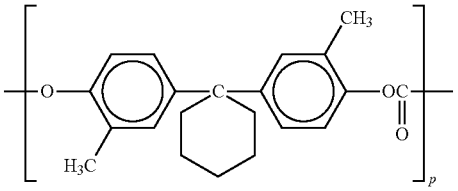

wherein p is the degree of polymerization.

24. The imaging member of claim 19, wherein the charge transport component is N,N'-diphenyl-N,N'-bis(3-methylphenyl)-1,1'-biphenyl-4,4'-diamine and is present in the top exposed charge transport layer in an amount less than that present in the bottom charge transport layer.

25. An imaging member comprising:

a flexible substrate;

a charge generating layer disposed on the substrate; and a multiple-layer charge transport layer including a bottom charge transport layer disposed on the charge generating layer, a plurality of middle charge transport layers disposed on the bottom charge transport layer, and a top exposed charge transport layer disposed on the plurality of middle charge transport layers, wherein each of layer of the multiple-layer charge transport layer comprises at least one liquid plasticizing compound present in the same weight percent in a solid solution further comprising a diamine charge transport component, and a polycarbonate binder, wherein the polycarbonate binder is an A-B diblock copolymer comprising two segmental blocks of a bisphenol A polycarbonate ($C_{16}H_{14}O_3$) and a phthalic acid, and further wherein the imaging member does not include an anticurl back coating layer.

* * * * *